US011525292B2

(12) United States Patent
Jeong

(10) Patent No.: US 11,525,292 B2
(45) Date of Patent: Dec. 13, 2022

(54) FLUSH HANDLE FOR DOOR OF VEHICLE

(71) Applicant: WOOBO TECH CO., LTD., Pyeongtaek-si (KR)

(72) Inventor: Hae Il Jeong, Incheon (KR)

(73) Assignee: Woobo Tech Co., Ltd., Gyeonggi-do (KR)

( * ) Notice: Subject to any disclaimer, the term of this patent is extended or adjusted under 35 U.S.C. 154(b) by 110 days.

(21) Appl. No.: 16/964,751

(22) PCT Filed: Apr. 27, 2020

(86) PCT No.: PCT/KR2020/005538
§ 371 (c)(1),
(2) Date: Jul. 24, 2020

(87) PCT Pub. No.: WO2021/210713
PCT Pub. Date: Oct. 21, 2021

(65) Prior Publication Data

US 2022/0154500 A1 May 19, 2022

(30) Foreign Application Priority Data

Apr. 16, 2020 (KR) ..... 10-2020-0046065

(51) Int. Cl.
*E05B 85/16* (2014.01)
*E05B 77/42* (2014.01)
(Continued)

(52) U.S. Cl.
CPC ..... *E05B 85/16* (2013.01); *E05B 77/42* (2013.01); *E05B 81/04* (2013.01); *E05B 81/77* (2013.01);
(Continued)

(58) Field of Classification Search
CPC ..... E05B 85/10; E05B 85/103; E05B 85/107; E05B 85/14; E05B 85/16; E05B 81/04;
(Continued)

(56) References Cited

U.S. PATENT DOCUMENTS

2001/0037702 A1 11/2001 McFarland et al.
2011/0148575 A1* 6/2011 Sobecki ..... E05B 17/10 292/336.3
(Continued)

FOREIGN PATENT DOCUMENTS

DE 10 2005 040 761 A1 3/2007
GB 2492231 B 10/2015
(Continued)

OTHER PUBLICATIONS

Machine translation and numbered paragraphs of WO2019120598 (Year: 2019).*
(Continued)

*Primary Examiner* — Christine M Mills
*Assistant Examiner* — Christopher F Callahan
(74) *Attorney, Agent, or Firm* — Sunstein LLP

(57) ABSTRACT

Disclosed is a flush handle for a door of a vehicle. The flush handle includes a housing installed in the door of the vehicle, a handle portion installed in the housing, a pivot portion formed on one side of the handle portion and including a rotating shaft, an interconnection groove formed in the pivot portion, a driving portion which is installed in the housing, includes an opening member having one side coupled to the interconnection groove, and is configured to linearly move and to transfer power to the handle portion, and a return spring installed on the rotating shaft. Here, when the opening member linearly moves, the pivot portion rotates on the rotating shaft through the interconnection groove such that the handle portion rotates.

7 Claims, 31 Drawing Sheets

(51) Int. Cl.

| | |
|---|---|
| ***E05B 81/04*** | (2014.01) |
| ***E05B 81/76*** | (2014.01) |
| ***E05B 83/36*** | (2014.01) |
| ***E05B 85/10*** | (2014.01) |
| *E05B 79/06* | (2014.01) |
| *E05B 79/20* | (2014.01) |

(52) U.S. Cl.
CPC ..... *E05B 83/36* (2013.01); *E05B 85/103* (2013.01); *E05B 79/06* (2013.01); *E05B 79/20* (2013.01)

(58) Field of Classification Search
CPC ..... E05B 81/76; E05B 81/77; E05B 81/78; E05B 81/90; E05B 77/36; E05B 77/42; E05B 83/36; E05B 79/06; Y10T 292/57; Y10S 292/08; Y10S 292/31; Y10S 292/56; Y10S 292/57; Y10S 292/58; Y10S 292/65
See application file for complete search history.

(56) References Cited

U.S. PATENT DOCUMENTS

| | | | | |
|---|---|---|---|---|
| 2014/0000167 | A1 | 1/2014 | Patel et al. | |
| 2014/0265372 | A1 | 9/2014 | Smart | |
| 2015/0233154 | A1 * | 8/2015 | Smart | E05B 85/107 70/237 |
| 2016/0290018 | A1 | 10/2016 | Hamacher et al. | |
| 2019/0283555 | A1 | 9/2019 | Couto Maquieira et al. | |

FOREIGN PATENT DOCUMENTS

| | | | | |
|---|---|---|---|---|
| JP | 3165570 | B2 | 3/2001 | |
| JP | 2001311339 | A | 11/2001 | |
| JP | 2014-522926 | A | 9/2014 | |
| JP | 2019-157613 | A | 9/2019 | |
| KR | 101855394 | B | 5/2018 | |
| WO | WO-2017025677 | A1 * | 2/2017 | E05B 85/103 |
| WO | WO-2019120598 | A1 * | 6/2019 | B60J 5/0468 |
| WO | WO 2019/133524 | A1 | 7/2019 | |

OTHER PUBLICATIONS

German Patent Office, Office Action, Application No. 11 2020 000 008.7, dated Feb. 22, 2021, 8 pages (in German).
Office Action issued in JP Application No. 2020-541727, dated Jul. 26, 2022, 4 pages (in Japanese).

* cited by examiner

FLUSH HANDLE FOR DOOR OF VEHICLE

This application is the national phase entry of international patent application no. PCT/KR2020/005538 filed Apr. 27, 2020 and claims the benefit of Korean patent application No. 10-2020-0046065, filed Apr. 16, 2020, the disclosures of which are incorporated herein by reference in their entirety.

TECHNICAL FIELD

The present invention relates to a flush handle withdrawn or inserted by pivoting with respect to a door of a vehicle.

BACKGROUND ART

Flush handles for a door of a vehicle are handles inserted and withdrawn outside a door panel of a vehicle.

A conventional flush handle for a door of a vehicle is disclosed in Japanese Patent Registration No. 2014-522926.

A housing type handle structure disclosed in "Japanese Patent Registration No. 2014-522926" includes a handle, an operating member formed on one side of the handle, a cam rotated by a motor and gears, and a rocker arm having one side frictionally coupled to the cam and the other side frictionally coupled to the operating member so as to move the operating member according to movement of the cam. When the operating member moves, the handle rotates around an axis of a pivot means.

"Japanese Patent Registration No. 2014-522926" has a problem that when the handle is withdrawn, the rocker arm pushes the operating member forward due to a frictional force and rotates the handle such that an operational feeling is not smooth.

Patent Document 1: Japanese Patent Registration No. 2014-522926

SUMMARY OF INVENTION

Technical Problem

The present invention is directed to providing a flush handle for a door of a vehicle, in which a pivot portion is formed on one side of a handle portion and an interconnection groove is formed in the pivot portion such that the handle portion is rotatable by applying a force to the pivot portion through the interconnection groove.

Solution to Problem

One aspect of the present invention provides a flush handle fora door of a vehicle. The flush handle includes a housing installed in the door of the vehicle, a handle portion installed in the housing, a pivot portion formed on one side of the handle portion and including a rotating shaft, an interconnection groove formed in the pivot portion, a driving portion which is installed in the housing, includes an opening member having one side coupled to the interconnection groove, and is configured to linearly move and to transfer power to the handle portion, and a return spring installed on the rotating shaft. Here, when the opening member linearly moves, the pivot portion rotates on the rotating shaft through the interconnection groove such that the handle portion rotates.

The pivot portion may include a pivot gear. The flush handle may further include an oil damper including a damper gear engaged with the pivot gear. Here, oil may be injected into the oil damper, and a main damper rotated by the damper gear may be installed in the oil damper, and a gap between the main damper and an inner wall of the oil damper may vary according to a rotational direction of the main damper. Also, the gap may be formed to be decreased more when rotation is performed in a direction in which the handle portion is inserted into the housing than when rotation is performed in a direction in which the handle portion is withdrawn from the housing.

The flush handle may further include a sub damper rotating in a direction opposite the rotational direction of the main damper due to an inertial force when the main damper rotates. Here, a gap between the sub damper and the inner wall of the oil damper may be formed to be decreased more when the rotation is performed in the direction in which the handle portion is inserted into the housing than when the rotation is performed in the direction in which the handle portion is withdrawn from the housing.

Another aspect of the present invention provides a flush handle fora door of a vehicle. The flush handle includes a housing installed in the door of the vehicle, a handle portion installed in the housing, a pivot portion formed on one side of the handle portion and including a rotating shaft, and a return spring installed on the rotating shaft. Here, the housing forms an accommodation groove 1102 which accommodates one end of the handle portion. The handle portion may be rotated on the rotating shaft and withdrawn from the housing when a pressure is applied to the one end of the handle portion. The handle portion may be withdrawn into the housing by the return spring when the pressure is removed.

The flush handle may further include a sensor portion which is pushed when the handle portion rotates by a certain distance or more and an electrically-powered latch portion configured to control fastening, unfastening, opening, and closing of the door of the vehicle. Here, when the sensor portion is pushed, the door of the vehicle may be opened by the electrically-powered latch portion.

The flush handle may further include a manually-operated latch portion or an electrically-powered latch portion, which controls fastening, unfastening, opening, and closing of the door of the vehicle and a door latch connection portion having one side installed on the handle portion and the other side installed on the manually-operated latch portion or the electrically-powered latch portion. Here, when the handle portion rotates by a certain distance or more, the door latch connection portion may be pulled such that the door of the vehicle may be opened by the manually-operated latch portion or the electrically-powered latch portion.

Advantageous Effects of Invention

According to the present invention, a flush handle for a door of a vehicle provides effects as follows.

Due to a pivot portion formed on one side of a handle portion, the handle portion may be withdrawn and inserted with the pivot portion as a rotating shaft with respect to the door of the vehicle.

An interconnection groove may be formed in the pivot portion, and the handle portion may be rotated using electric power by a driving portion including an opening member installed in the interconnection groove and capable of applying a force to the pivot portion.

A smooth operational feeling may be added in withdrawal and insertion of the handle portion using an oil damper interconnected with the pivot portion.

As resistance of the oil damper varies according to a rotational direction of the handle portion, the handle portion may be quickly operated by reducing the resistance when the handle portion is withdrawn and the handle portion may be slowly operated by increasing the resistance when the handle portion is inserted.

DETAILED DESCRIPTION OF EMBODIMENT

Hereinafter, exemplary embodiments of the present invention will be described in detail with reference to the attached drawings.

For reference, among components of the present invention which will be described below, the above background art will be referred to for components equal to those of the related art and an additional detailed description thereof will be omitted.

The technical terms are used herein merely to state particular embodiments and are not intended to limit the present invention. Singular forms used herein, unless defined otherwise clearly, include plural forms.

The meaning of "comprising" used in the specification specifies a particular property, region, integer, stage, operation, element and/or component and is not intended to exclude presence or addition of another particular property, region, integer, stage, operation, element, component, and/or group.

In the exemplary embodiments of the present invention, a forward and backward direction means a lateral direction (width direction) of a vehicle, a lateral direction means a forward and backward direction (longitudinal direction) of the vehicle, and a vertical direction means a vertical direction of the vehicle.

First Embodiment

Figure 1:
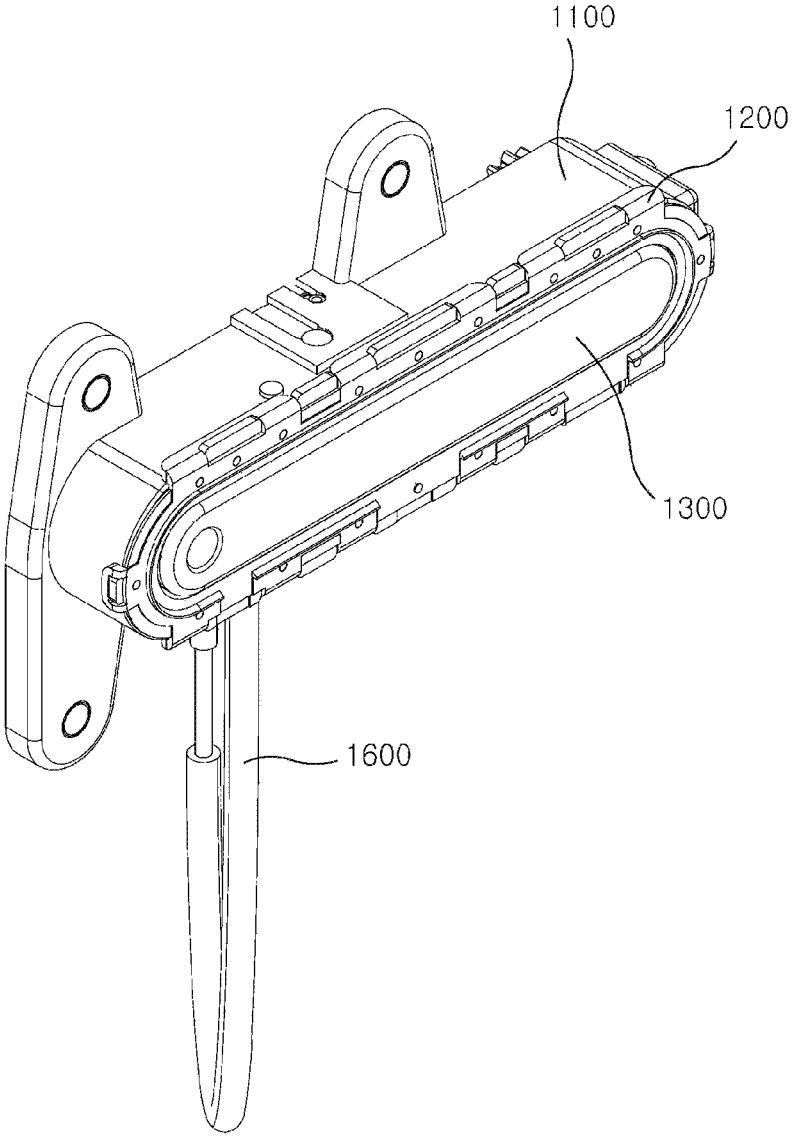
FIG. 1 is a front perspective view of a flush handle for a door of a vehicle according to a first exemplary embodiment of the present invention.
Figure 2:
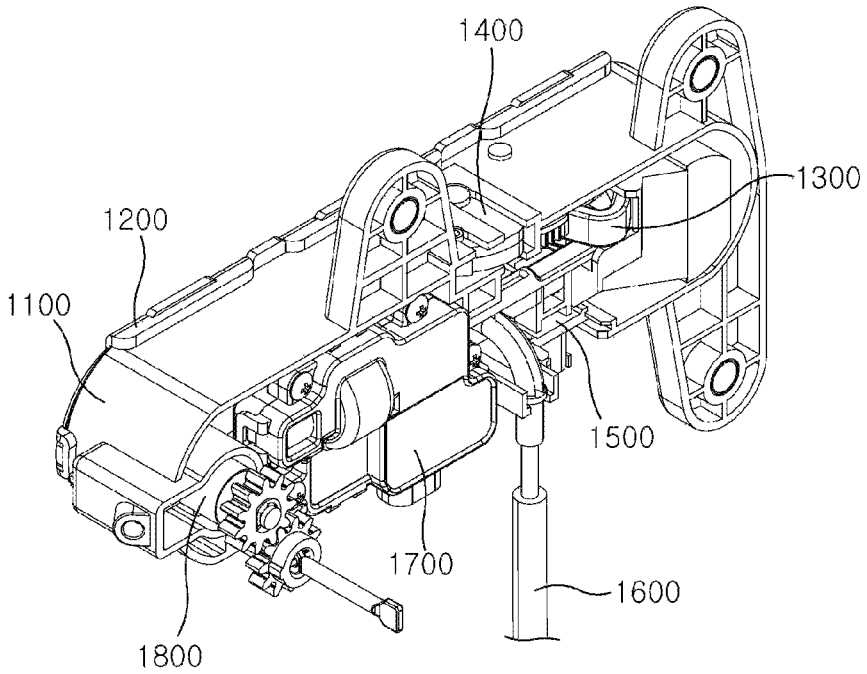
FIG. 2 is a rear perspective view of the flush handle according to the first exemplary embodiment of the present invention.
Figure 3:
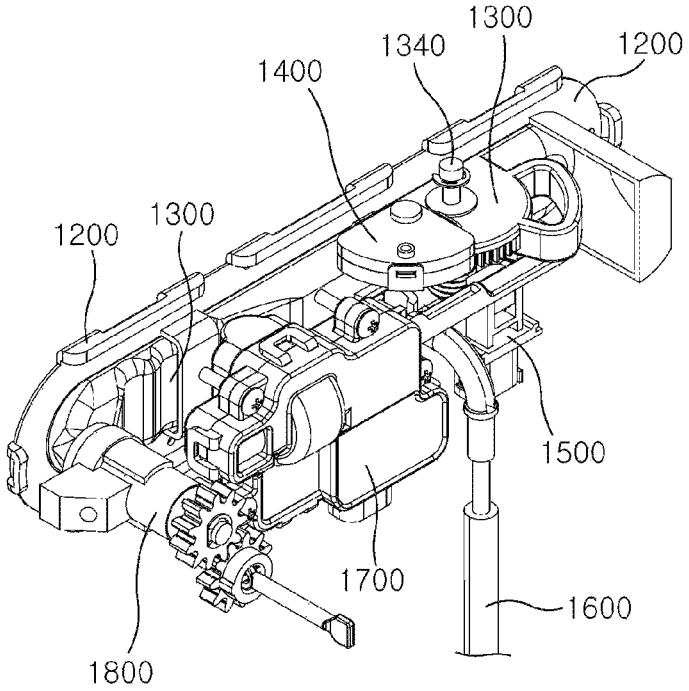
FIG. 3 is a rear perspective view of the flush handle, from which a housing is eliminated, according to the first exemplary embodiment of the present invention.

As shown in FIGS. 1 to 3, a flush handle for a door of a vehicle according to a first exemplary embodiment of the present invention includes a housing 1100, a handle portion 1300 installed in the housing 1100, and a driving portion 1700 configured to transmit power to the handle portion 1300.

The handle portion 1300 rotates on a rotating shaft 1340 to be withdrawn or inserted by the driving portion 1700.

Hereinafter, each of components will be described in detail with reference to FIGS. 6 and 7.

<Housing>

Figure 8:
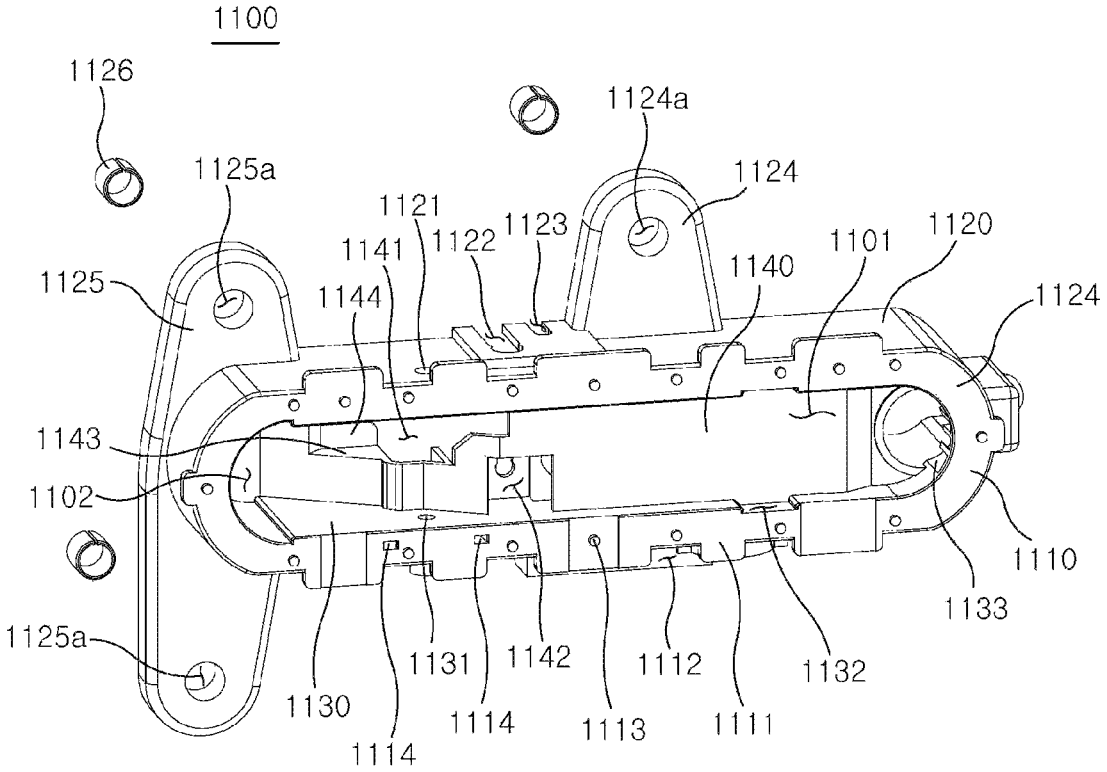
FIG. 8 is a front perspective view illustrating a housing of the flush handle according to the first exemplary embodiment of the present invention.
Figure 9:
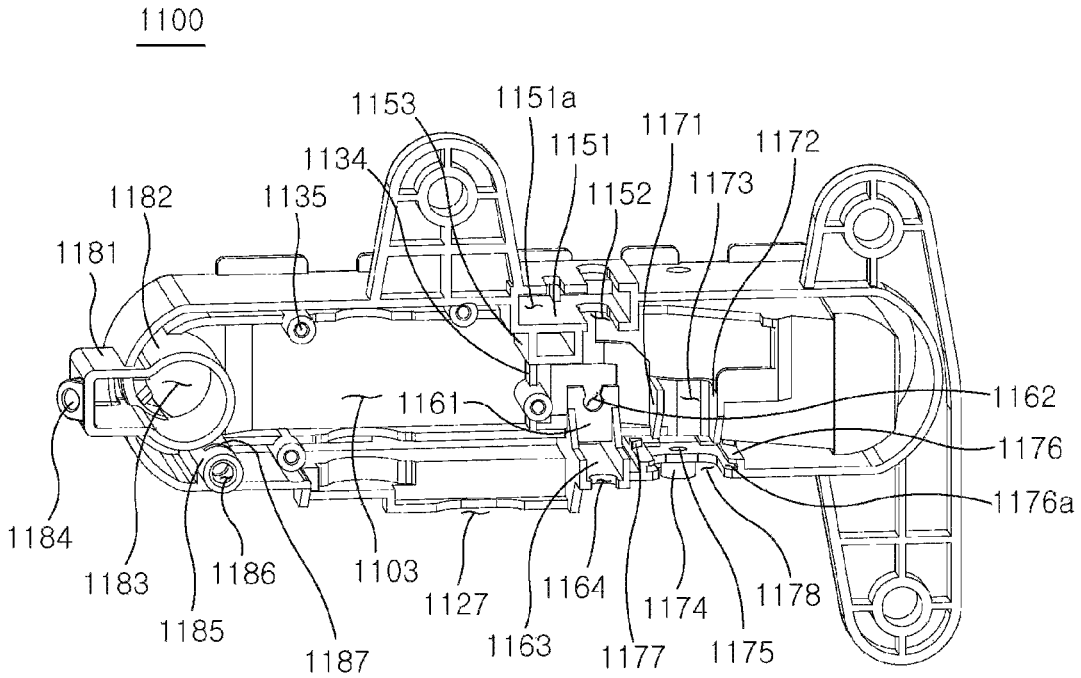
FIG. 9 is a rear perspective view illustrating the housing of the flush handle according to the first exemplary embodiment of the present invention.

The housing 1100 is shown in detail in FIGS. 8 and 9.

The housing 1100 is formed to have an overall shape of a rectangular parallelepiped which has an open rear. That is, the housing includes a front surface part and a perimeter portion formed to protrude backward from a perimeter of the front surface part.

The front surface part of the housing 1100 is formed as a front plate 1110.

The front plate 1110 is formed to be lengthwise in a lateral direction. A left side and a right side of the front plate 1110 are formed to have a semicircular shape.

A handle portion through groove 1101 is formed in the front plate 1110 to pass therethrough in a forward and backward direction. The handle portion through groove 1101 is formed along a shape of a perimeter of the front plate 1110. The handle portion through groove 1101 may be formed to be greater than a perimeter of the handle portion 1300, which will be described below, so that the handle portion 1300 may be withdrawn or inserted through the handle portion through groove 1101.

A bumper member insertion groove 1102 is formed on a left side of the handle portion through groove 1101. The bumper member insertion groove 1102 may be referred to as "an accommodation groove."

The bumper member insertion groove 1102 is formed to have a diameter greater than that of a semicircle on the left side of the handle portion through groove 1101. That is, a step is formed between the bumper member insertion groove 1102 and the handle portion through groove 1101. Accordingly, when a rotation-guide portion 1230 of a bumper member 1200, which will be described below, is inserted into the bumper member insertion groove 1102, the rotation-guide portion 1230 does not move further rightward than the bumper member insertion groove 1102.

The front plate 1110 includes, on a perimeter, a plurality of bumper coupling portions 1111 protruding outward from the front plate 1110 and a bumper insertion groove 1112 formed between the bumper coupling portions 1111.

The bumper coupling portion 1111 is formed lengthwise along the perimeter of the front plate 1110.

A bent portion 1221 of the bumper member 1200 which will be described below is coupled to the bumper coupling portion 1111 and the bumper insertion groove 1112.

A plurality of bumper coupling protrusions 1113 are formed to protrude forward between the perimeter of the front plate 1110 and the handle portion through groove 1101.

The bumper coupling protrusions 1113 are formed to have a cylindrical shape. Unlike the above description, the bumper coupling protrusions 1113 may be formed to have a different shape depending on a design of a car body.

The bumper coupling protrusions 1113 are inserted into second insertion grooves 1223 of the bumper member 1200 which will be described below.

A hook through groove 1114 is formed at a bottom of the left side of the front plate 1110 to pass therethrough in the forward and backward direction.

The hook through groove 1114 communicates with a sensor portion installation groove 1173 which will be described below.

A perimeter portion of the housing 1100 includes an outer perimeter portion 1120 formed to extend backward from a perimeter portion of the front plate 1110 and an inner perimeter portion 1130 formed to extend backward from a perimeter portion of the handle portion through groove 1101.

A rotating shaft insertion groove 1121 is formed on a top of a left side of each of the outer perimeter portion 1120 and the inner perimeter portion 1130 to pass therethrough in a vertical direction.

A top of the rotating shaft 1340 which will be described below is installed in the rotating shaft insertion groove 1121.

A first oil damper coupling groove 1122 and a second oil damper coupling groove 1123 are formed above a central part of the outer perimeter portion 1120 to have an open rear and pass therethrough in the vertical direction.

The first oil damper coupling groove 1122 and the second oil damper coupling groove 1123 are formed further rightward than the rotating shaft insertion groove 1121.

The first oil damper coupling groove 1122 is disposed further leftward than the second oil damper coupling groove 1123.

Protrusions are formed in front of the first oil damper coupling groove 1122 and the second oil damper coupling groove 1123 to protrude laterally inward. A first insertion protrusion 1415 of an oil damper 1400, which is installed in the first oil damper coupling groove 1122, and a second insertion protrusion 1416 of the oil damper 1400, which is installed in the oil second damper coupling groove 1123, are disposed in front of the protrusions and fixed after insertion.

A first door coupling portion 1124 is formed at the central part of the outer perimeter portion 1120 to protrude upward.

A door coupling groove 1124*a* is formed in a top of the first door coupling portion 1124 to pass therethrough in the forward and backward direction. A ring-shaped metal pad 1126 is installed in the door coupling groove 1124*a*. The first door coupling portion 1124 is fixed to the door of the vehicle through the door coupling groove 1124*a*.

A second door coupling portion 1125 is formed on the left side of the outer perimeter portion 1120 to protrude upward and downward.

A door coupling groove 1125*a* is formed in each of a top and bottom of the second door coupling portion 1125 to pass therethrough in the forward and backward direction. The ring-shaped metal pad 1126 is installed in the door coupling groove 1125*a*. The second door coupling portion 1125 is fixed to the door of the vehicle through the door coupling groove 1125*a*.

A power source portion installation groove 1127 is formed below the central part of the outer perimeter portion 1120 to have an open rear.

A front of a power source portion 1745 of the driving portion 1700 which will be described below is inserted into the power source portion installation groove 1127.

A rotating shaft insertion groove 1131 is formed at a bottom of a left side of the inner perimeter portion 1130 to pass therethrough in the vertical direction.

The rotating shaft insertion groove 1131 is disposed collinearly with the rotating shaft insertion groove 1121 formed above a left side of the housing 1100.

A bottom of the rotating shaft 1340 which will be described below is installed in the rotating shaft insertion groove 1131.

Bumper member insertion grooves 1132 are formed on a top and bottom of a right side of the inner perimeter portion 1130 to be recessed inward from the inner perimeter portion 1130.

A holding plate 1240 of the bumper member 1200, which will be described below, is inserted into the bumper member insertion groove 1132.

A partition 1140, which divides the inner perimeter portion 1130 into a front and a rear, is formed in the housing 1100.

A left side of the partition 1140 includes a tilted part gradually tilted backward from a right side toward a left side. The rotating shaft 1340 is disposed in a space formed in front of the tilted part of the partition 1140.

Accordingly, when the handle portion 1300 which will be described below is rotated around the rotating shaft 1340, a left side of the handle portion 1300 may be inserted and rotated toward the partition 1140. Here, a right side of the handle portion 1300 is withdrawn toward a front of the housing 1100.

When the handle portion 1300 is in an initial state, the right side of the handle portion 1300 comes into contact with a front surface of the partition 1140 on the basis of the rotating shaft 1340 and a position thereof is fixed thereto.

A pivot portion installation groove 1141 is formed at a top of the tilted part of the partition 1140 to pass therethrough in the forward and backward direction.

A pivot portion 1320 of the handle portion 1300 which will be described below is installed in the pivot portion installation groove 1141 and rotates without interference with the partition 1140.

A door latch connection portion through groove 1142 is formed at a bottom of the tilted part of the partition 1140 to pass therethrough in the forward and backward direction.

A holding portion 1330 of the handle portion 1300 which will be described below and a door latch connection portion 1600 are installed in the door latch connection portion through groove 1142. As the handle portion 1300 rotates, the door latch connection portion 1600 passes through the door latch connection portion through groove 1142 and moves toward a front of the handle portion 1300.

A pivot portion guide 1143 is formed on a left side of the pivot portion installation groove 1141 to be bent backward.

The pivot portion 1320 of the handle portion 1300 and a part of a third gear portion 1770 of the driving portion 1700 are disposed above the pivot portion guide 1143.

An opening member guide 1144 is formed behind the pivot portion guide 1143 to be bent upward.

An opening member 1772 of the driving portion 1700 which will be described below is disposed in front of the opening member guide 1144. Accordingly, the opening member 1772 is laterally slidable while a rear thereof is blocked by the opening member guide 1144.

An oil damper installation portion 1151 is formed below the first oil damper coupling groove 1122 and the second oil damper coupling groove 1123.

The oil damper installation portion 1151 is formed to have a rectangular parallelepiped shape.

An oil damper installation groove 1151*a* is formed in the oil damper installation portion 1151 to have an open rear. The oil damper installation groove 1151*a* communicates with the first oil damper coupling groove 1122 and the second oil damper coupling groove 1123.

A third oil damper coupling groove 1152 is formed in a bottom of a left side of the oil damper installation portion 1151 to have an open rear and to pass therethrough in the vertical direction.

The third oil damper coupling groove 1152 is collinearly disposed with the first oil damper coupling groove 1122 in the vertical direction and is formed to have a shape similar or equal to that of the first oil damper coupling groove 1122.

The third oil damper coupling groove 1152 communicates with the oil damper installation groove 1151*a*.

The oil damper 1400 which will be described below is inserted into the oil damper installation groove 1151*a*.

A third gear guide portion 1153 is formed below a right side of the oil damper installation portion 1151 to have a rectangular parallelepiped shape with an open rear.

The third gear guide portion 1153 is disposed further rightward than the third oil damper coupling groove 1152.

The opening member 1772 of the third gear portion 1770, which will be described below, is disposed below the third gear guide portion 1153.

The opening member 1772 is laterally slidable while a top thereof is blocked by the third gear guide portion 1153.

A partition 1134, which connects a bottom of the inner perimeter portion 1130 to a bottom of the third gear guide portion 1153, is formed behind the partition 1140.

The partition 1134 is disposed further rightward than the door latch connection portion through groove 1142.

A driving portion installation groove 1103 is formed in a surrounded space behind the partition 1134 and the right side of the inner perimeter portion 1130.

A driving portion installation boss 1135 is formed on the partition 1134 and the right side of the inner perimeter portion 1130 which surround the driving portion installation groove 1103 to protrude backward.

The driving portion 1700 which will be described below is screw-coupled to the driving portion installation boss 1135.

A door latch connection portion installation plate 1161 is formed behind the left side of the inner perimeter portion 1130 to protrude upward.

The door latch connection portion installation plate 1161 is disposed behind the door latch connection portion through groove 1142.

A door latch connection portion installation groove 1162 is formed in the door latch connection portion installation plate 1161 to have an open top and pass therethrough in the forward and backward direction.

A horizontal portion of a holding protrusion fixing portion 1602 of the door latch connection portion 1600 which will be described below is fixed to the door latch connection portion installation groove 1162.

A door latch connection portion through portion 1163 is formed below the door latch connection portion installation plate 1161 to extend backward.

A door latch connection portion through groove 1164 is formed in the door latch connection portion through portion 1163 to have an open rear and pass therethrough in the vertical direction.

A vertical portion of the holding protrusion fixing portion 1602 of the door latch connection portion 1600 which will be described below is fixed to the door latch connection portion through groove 1164.

Accordingly, the holding protrusion fixing portion 1602 may be fixed to the housing 1100 so as not to move.

A first sensor portion support plate 1171 and a second sensor portion support plate 1172 are formed below the pivot portion installation groove 1141 to protrude backward.

The first sensor portion support plate 1171 and the second sensor portion support plate 1172 are formed to be spaced apart from each other in the lateral direction, and the sensor portion installation groove 1173 is formed in the spaced space to have an open rear and an open top.

A rotating shaft installation portion 1174 is formed below the sensor portion installation groove 1173 to protrude below the outer perimeter portion 1120.

The rotating shaft installation portion 1174 is formed to have a cylindrical shape.

A rotating shaft insertion groove 1175 is formed in the rotating shaft installation portion 1174 to have an open top.

The rotating shaft insertion groove 1175 is disposed collinearly with the rotating shaft insertion groove 1131 formed below the left side of the inner perimeter portion 1130.

The bottom of the rotating shaft 1340 which will be described below is installed in the rotating shaft insertion groove 1175.

Sensor portion insertion portions 1176 are formed on a left side and a right side of the rotating shaft insertion groove 1175 to protrude above the outer perimeter portion 1120.

The sensor portion insertion portion 1176 is formed lengthwise in the forward and backward direction.

Sensor portion insertion grooves **1176*a* are formed in both of the sensor portion insertion portions 1176** to have an open inside and an open rear.

Holding protrusions 1177 are formed in front of both of the sensor portion insertion portions 1176 to protrude upward.

A power source portion installation groove 1178 is formed behind the rotating shaft insertion groove 1175 so that a rear of the outer perimeter portion 1120 is open and to vertically pass therethrough.

A front of a connector portion 1510 of a sensor portion 1500 which will be described below is inserted into the power source portion installation groove 1178.

A first key module installation portion 1181 and a second key module installation portion 1182 are formed on a right side of the housing 1100.

The first key module installation portion 1181 is formed to have a rectangular parallelepiped shape and to protrude rightward from the housing 1100.

The second key module installation portion 1182 is formed to have a cylindrical shape lengthwise in the forward and backward direction, is connected to a left side of the first key module installation portion 1181, and is disposed inside the outer perimeter portion 1120.

A key module installation groove 1183 is formed such that a rear of the first key module installation portion 1181 is opened and the second key module installation portion 1182 passes therethrough in the forward and backward direction.

A key module fastening groove 1184, which is screw-couplable to a key module 1800 inserted into the key module installation groove 1183, is formed in a right side of the first key module installation portion 1181.

A key cylinder holding portion 1133 is formed on a right side of the inner perimeter portion 1130.

The key cylinder holding portion 1133 is formed to protrude to block a right front of the key module installation groove 1183 formed on a right side of the partition 1140.

A slimming portion is formed on the key cylinder holding portion 1133 so that a front of a key cylinder 1810 installed in the key module installation groove 1183 is not allowed to move forward using a minimum component. Accordingly, a weight of the housing 1100 is reduced.

A second key gear portion installation portion 1185 is formed below the second key module installation groove 1183 to protrude backward.

The second key gear portion installation portion 1185 is formed to have a cylindrical shape lengthwise in the forward and backward direction.

A second key gear portion installation groove 1186 is formed in the second key gear portion installation portion 1185 to have an open rear.

A second key gear portion coupling groove 1187 is formed behind the second key gear portion installation portion 1185 to pass therethrough in the vertical direction.

The second key gear portion coupling groove 1187 is formed along upper and lower perimeters of the second key gear portion installation portion 1185 to have a circular arch shape.

A second key gear portion 1840 which will be described below is inserted into the second key gear portion installation groove 1186 and then is hook-coupled and fixed to the second key gear portion coupling groove 1187.

<Bumper Member>

Figure 10:
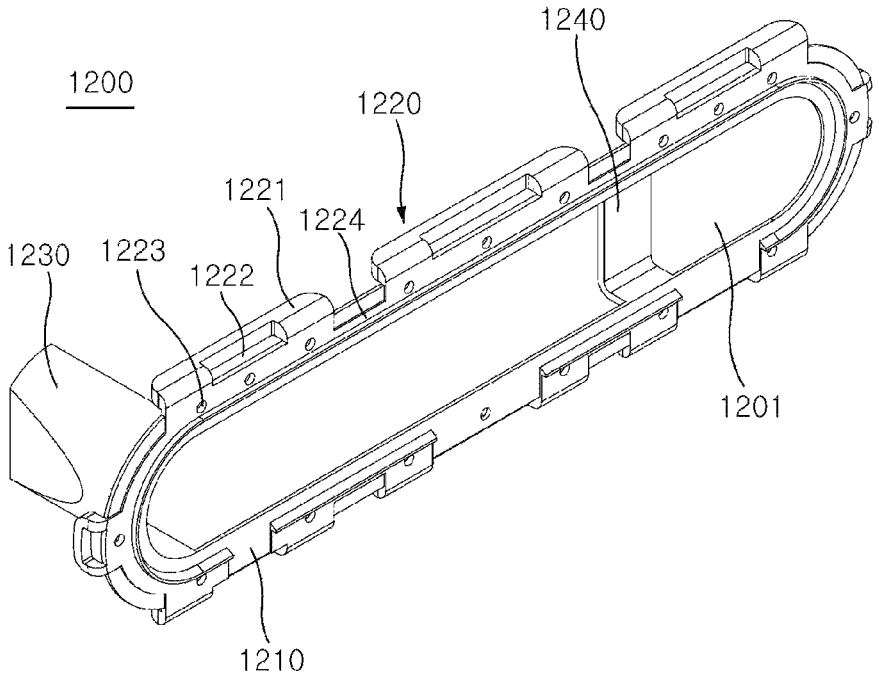
FIG. 10 is a front perspective view illustrating a bumper member of the flush handle according to the first exemplary embodiment of the present invention.
Figure 11:
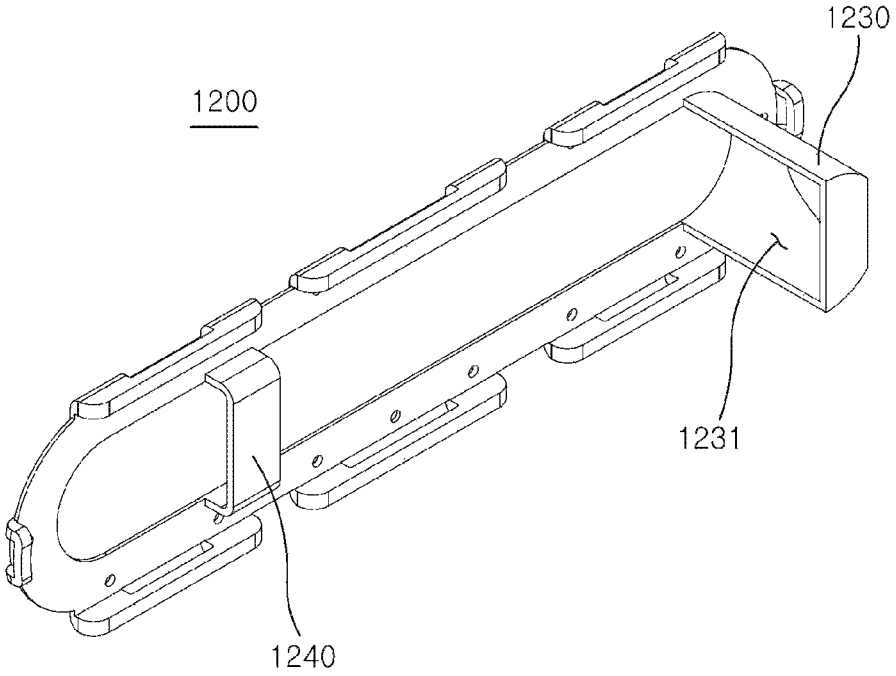
FIG. 11 is a rear perspective view illustrating the bumper member of the flush handle according to the first exemplary embodiment of the present invention.

The bumper member 1200 is shown in detail in FIGS. 10 and 11.

The bumper member 1200 is formed to have an overall shape of a plate.

The bumper member 1200 may be formed of a rubber material.

The bumper member 1200 includes a shielding plate 1210 disposed on an front surface of the front plate 1110 of the housing 1100 and a coupling portion 1220 formed in front of the shielding plate 1210 and coupled to the front plate 1110 of the housing 1100.

The shielding plate 1210 is formed to be lengthwise in the lateral direction. A left side and a right side of the shielding plate 1210 are formed to have a semicircular shape. That is, the shielding plate 1210 is formed to have a similar shape to that of the front plate 1110 of the housing 1100.

A handle portion through groove 1201 is formed in the shielding plate 1210 to pass therethrough in the forward and backward direction.

The handle portion through groove 1201 is formed along a shape of a perimeter of the shielding plate 1210. The handle portion through groove 1201 may be formed to be greater than the perimeter of the handle portion 1300, which will be described below, such that the handle portion 1300 may be withdrawn or inserted through the handle portion through groove 1201.

The handle portion through groove 1201 communicates with the handle portion through groove 1101 of the housing 1100.

The coupling portion 1220 includes a plurality of such bent portions 1221 which extend outward from the shielding plate 1210 and are bent backward.

The bent portion 1221 is formed lengthwise along the perimeter of the shielding plate 1210.

A first insertion groove 1222 is formed in the bent portion 1221 to pass therethrough in an inward and outward direction of the perimeter of the shielding plate 1210.

The bumper coupling portion 1111 of the housing 1100 is inserted into the first insertion groove 1222.

Both sides of the bent portion 1221 on the basis of the first insertion grooves 1222 are inserted into the bumper insertion groove 1112 of the housing 1100.

A plurality of such second insertion grooves 1223 are formed in the coupling portion 1220 to pass therethrough in the forward and backward direction.

The bumper coupling protrusion 1113 of the front plate 1110 is inserted into the second insertion groove 1223.

Accordingly, the bumper member 1200 is firmly coupled to the housing 1100.

An inflow prevention plate 1224 is formed on an inner perimeter of the coupling portion 1220 adjacent to the handle portion through groove 1201 to protrude forward.

The inflow prevention plate 1224 blocks the handle portion through groove 1201 to prevent rainwater or foreign substances from flowing thereinto.

A plurality of opening portions are formed below the coupling portion 1220.

That is, a bottom of the shielding plate 1210 has a part where the coupling portion 1220 is not formed.

Accordingly, rainwater or foreign substances which are collected inside the inflow prevention plate 1224 may be discharged below the bumper member 1200 through the opening portions.

The rotation-guide portion 1230 is formed on a left side of the bumper member 1200 to protrude backward.

A rotation-guide groove 1231 having an open right side is formed in the rotation-guide portion 1230.

The rotation-guide groove 1231 is inserted into the bumper member insertion groove 1102 of the housing 1100.

The left side of the handle portion 1300 which will be described below is installed in the rotation-guide groove 1231 and rotates along an inner surface of the rotation-guide groove 1231.

The holding plate 1240 is formed on a right side of the bumper member 1200 to be bent backward.

The holding plate 1240 is formed to extend to be bent backward from a top and a bottom of the bumper member 1200 and then be bent upward or downward to be connected to each other.

A top and a bottom of the holding plate 1240 are inserted into the bumper member insertion groove 1132 of the housing 1100.

The right side of the handle portion 1300 comes into contact with the holding plate 1240.

Even when the right side of the handle portion 1300 is unexpectedly inserted, an impact applied to the handle portion 1300 is reduced by the holding plate 1240.

<Handle Portion>

Figure 12:
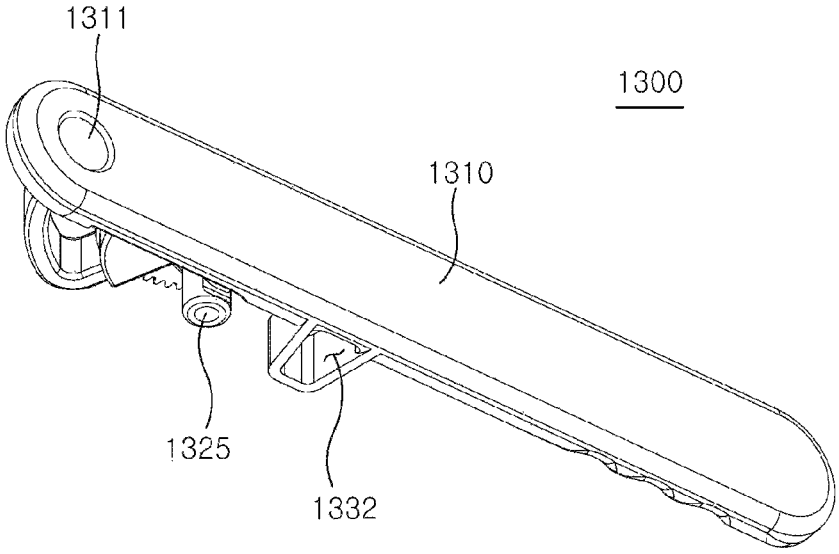
FIG. 12 is a front perspective view illustrating a handle portion of the flush handle according to the first exemplary embodiment of the present invention.
Figure 13:
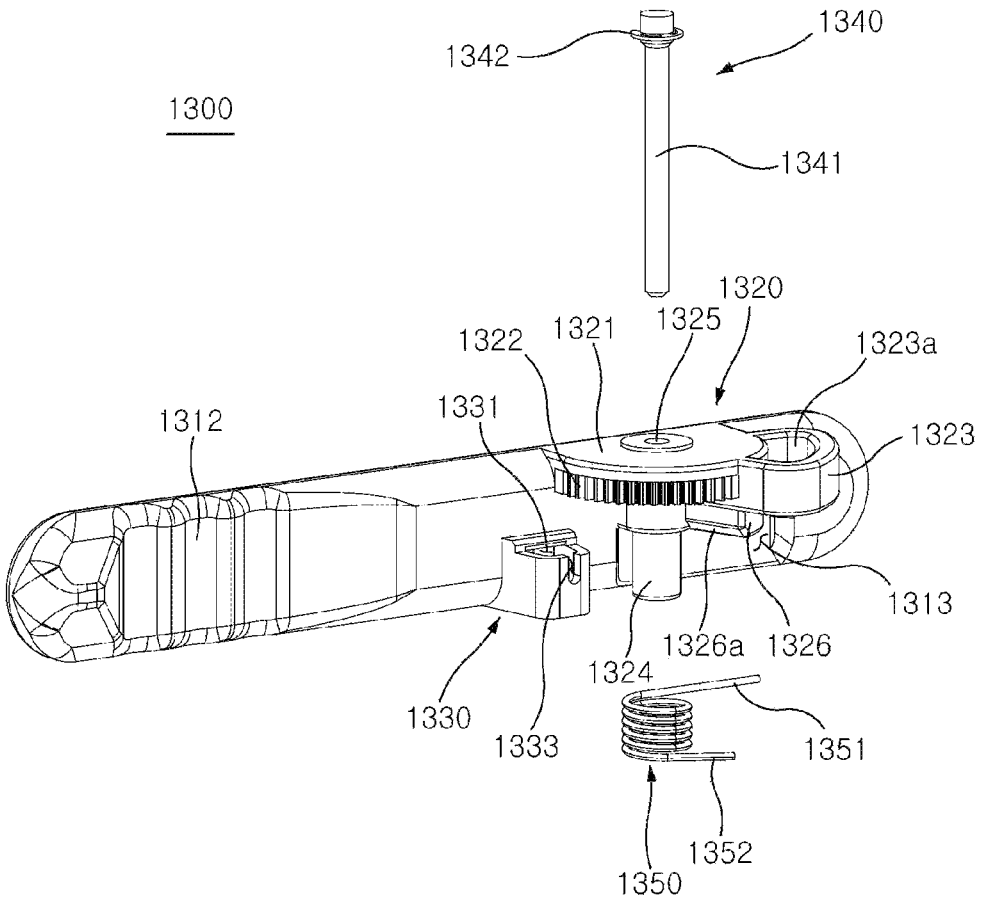
FIG. 13 is a rear perspective view illustrating the handle portion of the flush handle according to the first exemplary embodiment of the present invention.

The handle portion 1300 is shown in detail in FIGS. 12 and 13.

The handle portion 1300 includes a handle 1310 directly held by a user, the pivot portion 1320 formed behind a left side of the handle 1310 and becoming a central shaft when the handle portion 1300 rotates, and the holding portion 1330 formed behind the handle 1310 such that the door latch connection portion 1600 which will be described below is installed The handle 1310 is formed to have an overall shape of a plate.

The handle 1310 is formed to be lengthwise in the lateral direction. A left side and a right side of the handle 1310 are formed to have a semicircular shape.

The handle 1310 is formed to have a shape similar or equal to a shape of the handle portion through groove 1201 of the bumper member 1200.

A push portion 1311 is formed in front of the left side of the handle 1310 to be recessed backward.

The push portion 1311 is formed to have a circular shape.

Due to the push portion 1311, the user may intuitively know which part of the handle 1310 should be pushed to allow the handle 1310 to rotate and be withdrawn.

A grip portion 1312 is formed behind the right side of the handle 1310 to have an uneven shape.

The grip portion 1312 is formed according to a finger shape to allow a finger of the user to be mounted without slipping.

A return spring support groove 1313 is formed behind the left side of the handle 1310 to be recessed forward.

The return spring support groove 1313 is formed below the handle 1310.

A first end 1351 of a return spring 1350 which will be described below is fixed to the return spring support groove 1313.

The pivot portion 1320 includes a circular plate 1321 formed on a top of the handle 1310, an interconnection member 1323 formed to protrude backward from a left side of the circular plate 1321, and a sensor push portion 1326 formed on the left side of the circular plate 1321 to protrude downward.

A rotating shaft of the circular plate 1321 is formed in a vertical direction.

The circular plate 1321 is formed such that a center of a circle is located further backward than the handle 1310.

A pivot gear 1322 having the same diameter as a diameter of the circular plate 1321 is formed below the circular plate 1321.

The pivot gear 1322 is formed to be a spur gear.

A rotating shaft installation portion 1324 is formed on the pivot gear 1322 to protrude downward.

The return spring 1350 is installed on an outer surface of the rotating shaft installation portion 1324.

The return spring 1350 is provided as a coil spring.

A first end 1351 extending along the return spring support groove 1313 of the handle 1310 is formed at a top of the return spring 1350, and a second end 1352 extending along a left side of the partition 1140 of the housing 1100 is formed at a bottom of the return spring 1350.

Accordingly, the return spring 1350 is elastically deformed between the return spring support groove 1313 and the partition 1140 due to rotation of the handle portion 1300.

A rotating shaft installation groove 1325 is formed to vertically pass through the circular plate 1321, the pivot gear 1322, and the rotating shaft installation portion 1324.

The rotating shaft 1340 is installed in the rotating shaft installation groove 1325.

The rotating shaft 1340 includes a rotating shaft body 1341 formed to have a pin shape and a groove formed at a top of the rotating shaft body 1341 to allow a rotating shaft holding plate 1342 to be inserted thereinto. The groove is disposed to be located directly below the rotating shaft insertion groove 1121 after the rotating shaft 1340 is installed in the housing 1100.

The rotating shaft holding plate 1342 includes an opening on one side to fit on the rotating shaft body 1341.

The rotating shaft 1340 is inserted into the rotating shaft insertion grooves 1121, 1131, and 1175 of the housing 1100 from top to bottom.

The bottom of the rotating shaft 1340 is blocked by the rotating shaft installation portion 1174 of the housing 1100.

Afterward, when the rotating shaft holding plate 1342 fits on the top of the rotating shaft body 1341, the rotating shaft holding plate 1342 is held by an inner surface of the outer perimeter portion 1120 of the housing 1100. Accordingly, the rotating shaft 1340 does not move upward.

The interconnection member 1323 is formed to protrude along a perimeter part of the circular plate 1321 in a circular arc shape.

When viewed from the lateral direction, a right end of the interconnection member 1323 is formed to be located further leftward than the rotating shaft installation groove 1325.

An interconnection groove 1323*a* is formed in the interconnection member 1323 to vertically pass therethrough along a shape of a perimeter of the interconnection member 1323.

Accordingly, when a handle portion holding protrusion 1777 of the driving portion 1700 which will be described below is inserted into the interconnection groove 1323*a* and pulls the interconnection groove 1323*a* rightward, the pivot portion 1320 may rotate clockwise.

The sensor push portion 1326 is formed to protrude downward far enough to push a top of a sensor 1540 installed in the housing 1100.

A sensor push portion tilted surface 1326*a* formed to be tilted downward from a right side to a left side is formed on a right end of the sensor push portion 1326.

When the handle portion 1300 is rotated due to the sensor push portion tilted surface 1326*a*, the sensor push portion 1326 may smoothly push the top of the sensor 1540.

The holding portion 1330 is formed at a bottom of a rear side of the handle 1310.

A door latch connection portion insertion groove 1331 is formed at a top of the holding portion 1330 to vertically pass therethrough, and a door latch connection portion installation groove 1332 is formed at a bottom of the holding portion 1330 to have an open bottom.

The door latch connection portion insertion groove 1331 and the door latch connection portion installation groove 1332 communicate with each other.

The door latch connection portion installation groove 1332 is formed to be recessed further forward than the door latch connection portion insertion groove 1331.

Accordingly, when a holding protrusion 1601 of the door latch connection portion 1600 which will be described below is inserted into the door latch connection portion insertion groove 1331 and then moves toward a front of the door latch connection portion installation groove 1332, the holding protrusion 1601 does not come out in an upward direction.

A door latch connection portion insertion groove 1333 is formed behind the holding portion 1330 to be opened upward.

A cable 1603 of the door latch connection portion 1600 which will be described below is installed in the door latch connection portion insertion groove 1333. Accordingly, the cable 1603 of the door latch connection portion 1600 does not move in the lateral direction.

<Oil Damper>

Figure 14:
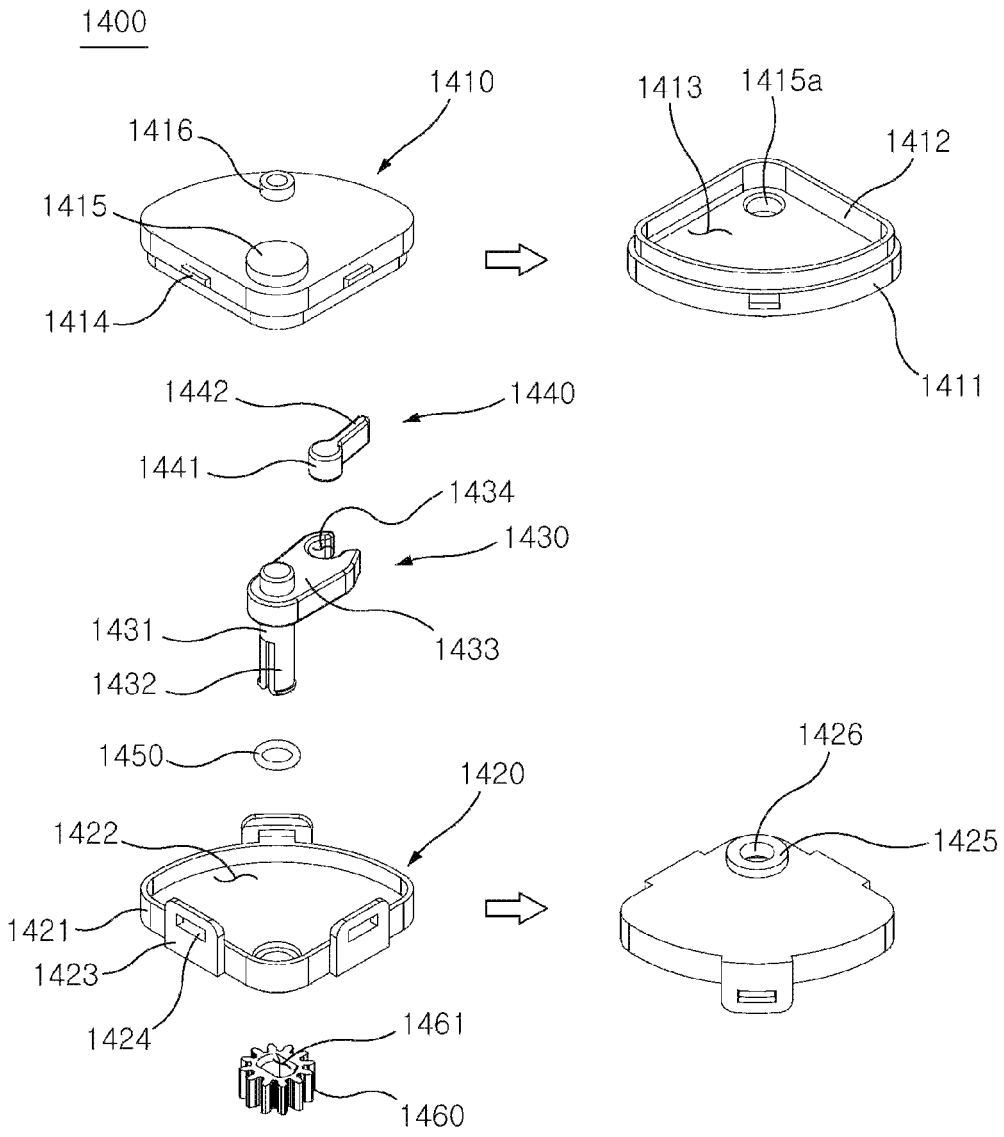
FIG. 14 is an exploded perspective view illustrating an oil damper of the flush handle according to the first exemplary embodiment of the present invention.

The oil damper 1400 is shown in detail in FIG. 14.

The oil damper 1400 includes an upper case 1410, a lower case 1420 coupled to a bottom of the upper case 1410, a main damper 1430 rotatably installed between the upper case 1410 and the lower case 1420, and a sub damper 1440 rotatably installed on the main damper 1430.

The upper case 1410 is formed to have a fan shape having a central angle of 90 degrees.

The upper case 1410 is installed in the housing 1100 so that an arc is located behind a right side.

A first internal space 1413 is formed in the upper case 1410 to have an open bottom.

A perimeter portion of the upper case 1410 includes an outer perimeter portion 1411 formed at a top of the upper case 1410 and an inner perimeter portion 1412 formed at a bottom of the outer perimeter portion 1411 to be further inward than the outer perimeter portion 1411.

That is, a step is formed between an outer surface of the outer perimeter portion 1411 and an outer surface of the inner perimeter portion 1412.

A plurality of coupling protrusions 1414 are formed on the outer surface of the outer perimeter portion 1411.

A first insertion protrusion 1415 and a second insertion protrusion 1416 are formed on a top surface of the upper case 1410 to protrude upward.

The first insertion protrusion 1415 and the second insertion protrusion 1416 are formed to have a cylindrical shape.

The first insertion protrusion 1415 is formed on a front of a left side of the top surface of the upper case 1410, and the second insertion protrusion 1416 is formed on a rear of a right side of the upper case 1410.

A shaft insertion groove 1415*a* is formed in the first insertion protrusion 1415 to have an open bottom.

A groove is formed in the second insertion protrusion 1416 to have an open top.

Accordingly, when the first insertion protrusion 1415 and the second insertion protrusion 1416 are installed in the first oil damper coupling groove 1122 and the second oil damper coupling groove 1123 of the housing 1100, respectively, the first insertion protrusion 1415 and the second insertion protrusion 1416 are elastically deformed to be easily installed.

Also, since the first insertion protrusion 1415 and the second insertion protrusion 1416 are located in a diagonal direction to each other, even when the main damper 1430 which will be described below is rotated around a center of the first insertion protrusion 1415 as a rotation axis, the upper case 1410 is not rotated due to the second insertion protrusion 1416.

The lower case 1420 is formed to have an overall shape similar or equal to a shape of the upper case 1410.

A second internal space 1422 is formed in the lower case 1420 to have an open top.

A perimeter portion of the lower case 1420 includes an outer perimeter portion 1421 which is installed outside the inner perimeter portion 1412 of the upper case 1410 and comes into contact with a bottom surface of the outer perimeter portion 1411 of the upper case 1410.

When the upper case 1410 and the lower case 1420 are coupled, the inner perimeter portion 1412 and the first internal space 1413 of the upper case 1410 are included in the second internal space 1422.

An oil having high viscosity is injected into the first internal space 1413.

A plurality of coupling portions 1423 are formed on an outer surface of the outer perimeter portion 1421 to protrude upward.

A coupling groove 1424 is formed in the coupling portion 1423 to pass therethrough in an inward and outward direction of the outer perimeter portion 1421.

The coupling protrusion 1414 of the upper case 1410 is inserted into the coupling groove 1424.

A boss 1425 is formed on a bottom surface of the lower case 1420 to protrude downward.

The boss 1425 is formed collinearly with the first insertion protrusion 1415 of the upper case 1410 in the vertical direction.

The boss 1425 is installed in the third oil damper coupling groove 1152 of the housing 1100.

A shaft through groove 1426 is formed in the boss 1425 to vertically pass therethrough.

The upper case 1410 and the lower case 1420 are inserted into the oil damper installation groove 1151*a* of the housing 1100 and not vertically moved.

The main damper 1430 includes a damper shaft 1431 installed in the shaft insertion groove 1415*a* of the upper case 1410 and the shaft through groove 1426 of the lower case 1420 and includes a rotation portion 1433 rotated around the damper shaft 1431 as a rotation axis in the first internal space 1413.

The damper shaft 1431 is formed to have a pin shape.

A damper shaft coupling portion 1432 to be hook-coupled to a damper gear 1460 which will be described below is formed below the damper shaft 1431.

A left surface and a right surface of the damper shaft coupling portion 1432 are formed as flat surfaces.

A bottom of the damper shaft coupling portion 1432 is formed so that a front and a rear of the damper shaft coupling portion 1432 are spaced apart from each other. Accordingly, the damper shaft coupling portion 1432 may be elastically deformed.

The damper gear 1460 is installed on the damper shaft coupling portion 1432.

The damper gear 1460 is formed to engage with the pivot gear 1322 of the handle portion 1300.

A damper shaft coupling groove 1461 is formed in the damper gear 1460 to vertically pass therethrough.

A left surface and a right surface of the damper shaft coupling groove 1461 are formed as flat surfaces.

The damper shaft coupling portion 1432 is coupled to the damper shaft coupling groove 1461.

Accordingly, the damper gear 1460 does not run idle with respect to the damper shaft 1431. Also, when the damper gear 1460 rotates, the damper shaft 1431 interconnects and rotates therewith.

The rotation portion 1433 is formed to have an overall shape of a bar.

Atop surface of the rotation portion 1433 comes into contact with the upper case 1410, and a bottom surface of the rotation portion 1433 comes into contact with the lower case 1420.

One side of the rotation portion 1433 is connected to the damper shaft 1431, and the rotation portion 1433 interconnects and rotates with the damper shaft 1431.

A sub damper installation groove 1434 where an opening portion is formed is formed on the other side of the rotation portion 1433. The sub damper installation groove 1434 is formed to have a circular shape.

The sub damper 1440 is formed to have an overall shape of a bar.

The sub damper 1440 includes a main damper insertion portion 1441 inserted into the sub damper installation groove 1434 and a distance adjusting portion 1442 formed to protrude outward from the main damper insertion portion 1441.

The main damper insertion portion 1441 is formed, in a circular shape, along a shape of the sub damper installation groove 1434 and is rotated inside the sub damper installation groove 1434.

When it is assumed that a line, which connects a center of the damper shaft 1431 of the main damper 1430 to a center of the sub damper installation groove 1434, is referred to as line A and a line, which connects one side to the other side of the sub damper 1440, is referred to as line B, one side of the opening portion of the sub damper installation groove 1434 is formed such that the line A and the line B form a straight line when the distance adjusting portion 1442 is maximally rotated counterclockwise, and the other side of the opening portion of the sub damper installation groove 1434 is formed such that the line A and the line B does not form a straight line when the distance adjusting portion 1442 is maximally rotated clockwise.

The distance adjusting portion 1442 is formed to be long enough to nearly reach an inner surface of the upper case 1410 when the distance adjusting portion 1442 is maximally rotated counterclockwise.

That is, as the distance adjusting portion 1442 is rotated clockwise, the distance adjusting portion 1442 and the inner surface of the upper case 1410 are gradually spaced apart from each other.

A space in which an O ring 1450 is installable is formed at a top of the boss 1425 of the lower case 1420 to be recessed downward.

Due to the O ring 1450, a phenomenon in which an oil injected into the first internal space 1413 is discharged below the lower case 1420 through the shaft through groove 1426 is minimized.

<Sensor Portion>

Figure 15:
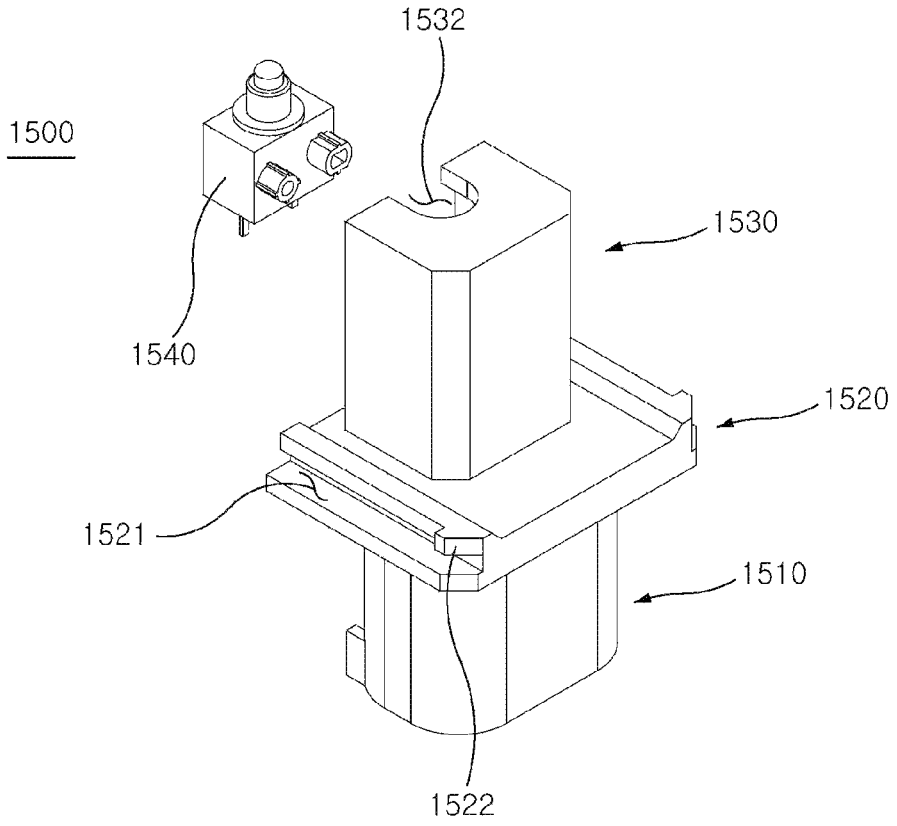
FIG. 15 is a front exploded perspective view illustrating a sensor portion of the flush handle according to the first exemplary embodiment of the present invention.
Figure 16:
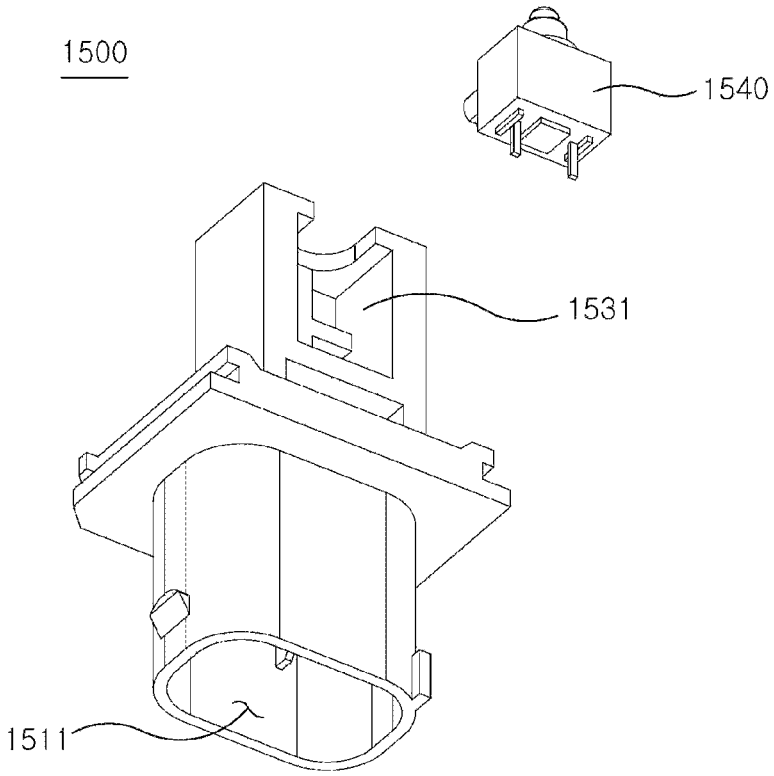
FIG. 16 is a rear exploded perspective view illustrating the sensor portion of the flush handle according to the first exemplary embodiment of the present invention.
Figure 17:
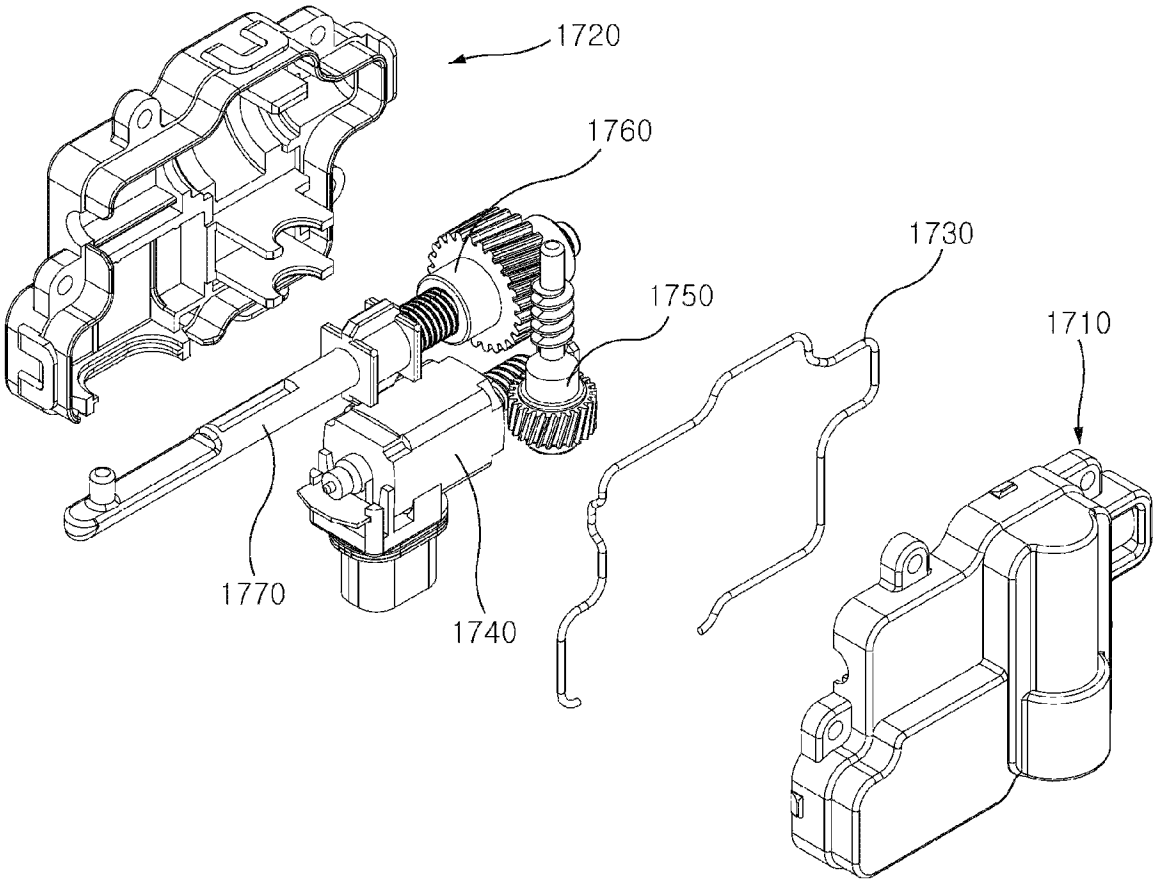
FIG. 17 is a front exploded perspective view illustrating a driving portion of the flush handle according to the first exemplary embodiment of the present invention.

The sensor portion 1500 is shown in detail in FIGS. 15 and 16.

The sensor portion 1500 includes a connector portion 1510 to which a signal is connected from the outside, an installation portion 1520 formed above the connector portion 1510 and hook-coupled to the housing 1100, and a sensor installation portion 1530 formed to protrude above the installation portion 1520.

The connector portion 1510 is formed to have an overall shape of a column.

A connector installation groove 1511 is formed in the connector portion 1510 to have an open bottom.

A signal cable is stuck into the connector installation groove 1511.

The installation portion 1520 is formed to have a quadrangular plate shape.

Insertion grooves 1521 are formed in a left side and a right side of the installation portion 1520 to have an open left or right side and to pass therethrough in the forward and backward direction.

The sensor portion insertion portion 1176 of the housing 1100 are inserted into the insertion grooves 1521.

A bottom of the installation portion 1520, on the basis of the insertion groove 1521, is inserted into the sensor portion insertion groove 1176*a* of the housing 1100.

A holding protrusion 1522 is formed at a top of the installation portion 1520 on the basis of the insertion groove 1521 to protrude leftward or rightward.

The holding protrusion 1522 is formed at a front of the installation portion 1520.

An outer surface of the holding protrusion 1522 is formed to be gradually tilted inward from a rear to a front.

Accordingly, the holding protrusion 1522 may be hook-coupled to a front of the holding protrusion 1177 formed on the sensor portion insertion portion 1176 of the housing 1100.

The sensor installation portion 1530 is formed to have an overall shape of a square column.

A sensor installation groove 1531 is formed in the sensor installation portion 1530 to have an open rear.

A sensor protruding groove 1532 is formed at a top of the sensor installation portion 1530 to have an open rear and pass therethrough in the vertical direction.

A bottom of the sensor protruding groove 1532 communicates with the sensor installation groove 1531.

Accordingly, when the sensor 1540 is installed in the sensor installation portion 1530 and the sensor protrusion groove 1532, apart of the sensor 1540 protrudes above the sensor protrusion groove 1532 and becomes pushable by the sensor push portion 1326 of the handle portion 1300.

<Door Latch Connection Portion>

Figure 6:
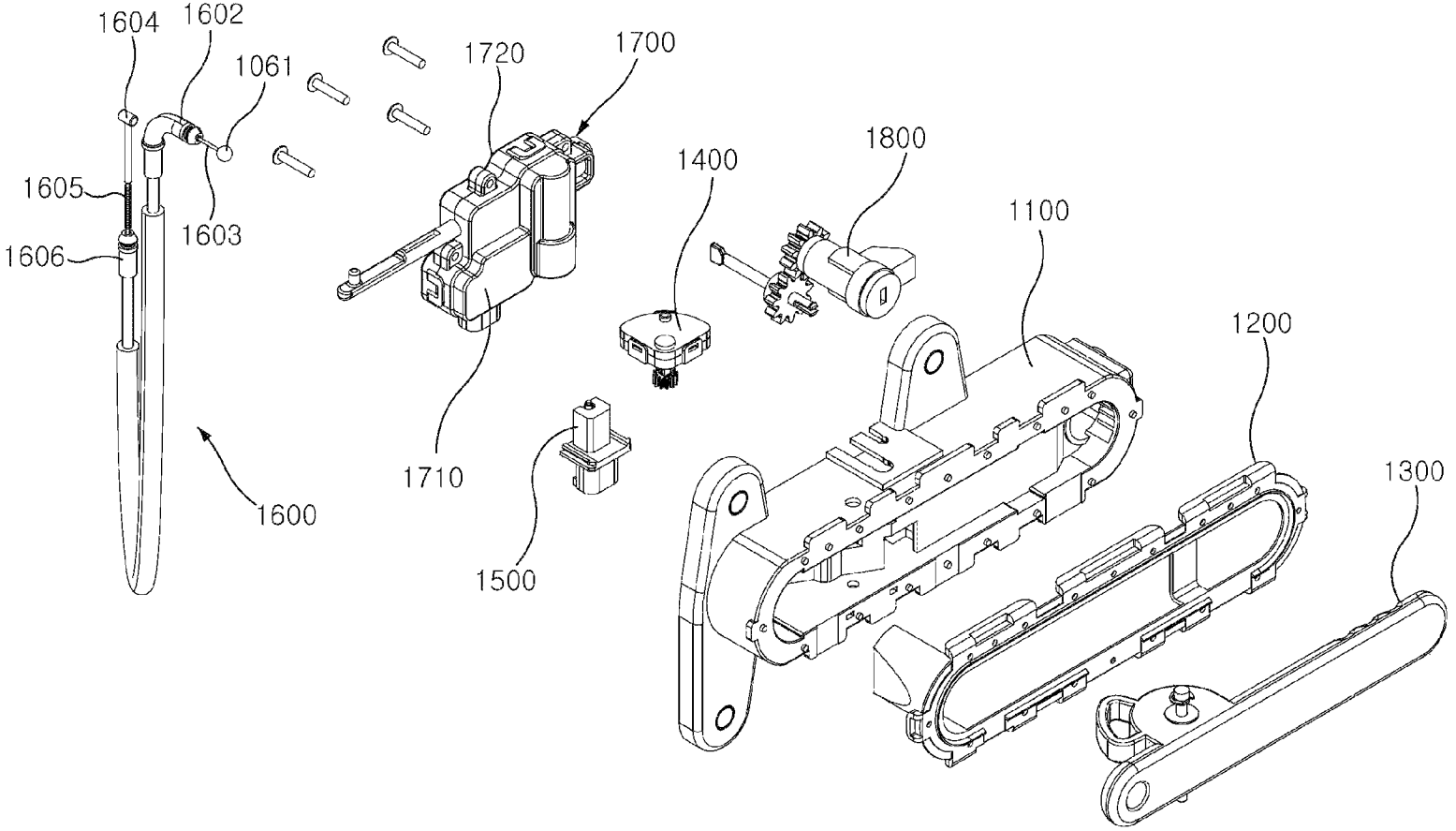
FIG. 6 is a front exploded perspective view of the flush handle according to the first exemplary embodiment of the present invention.
Figure 7:
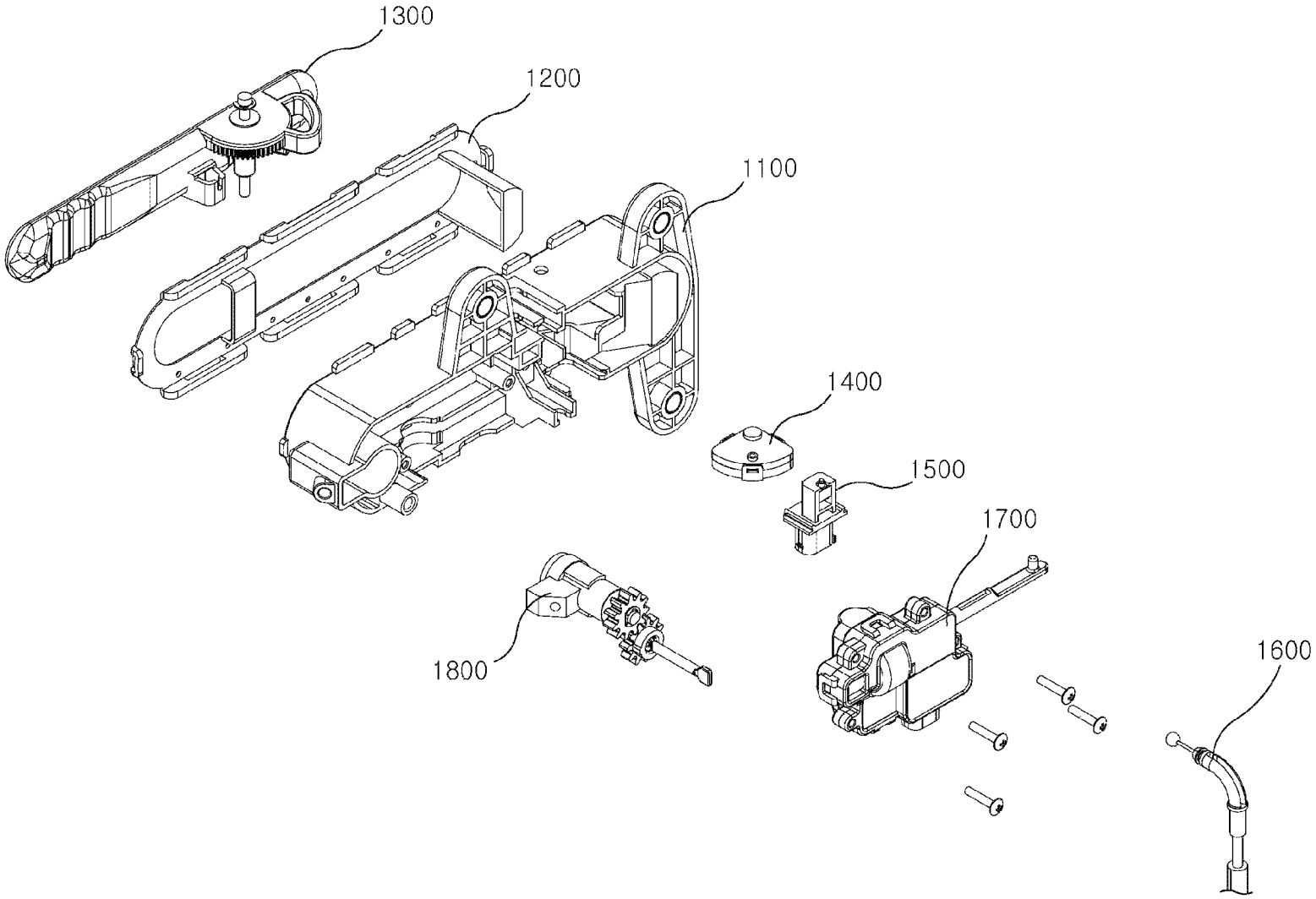
FIG. 7 is a rear exploded perspective view of the flush handle according to the first exemplary embodiment of the present invention.

The door latch connection portion 1600 is shown in detail in FIG. 6.

The holding protrusion 1601 is formed on one side of the door latch connection portion 1600, and a stopper 1604 is formed on the other side of the door latch connection portion 1600.

The holding protrusion 1601 and the stopper 1604 are connected using a cable 1603.

The holding protrusion 1601 is installed on the holding portion 1330 of the handle portion 1300, and the stopper 1604 is installed in a latch portion (not shown) which fastens or unfastens the door of the vehicle. Here, the latch portion may be manually operated or electrically powered.

The cable 1603 is covered by a tube. The holding protrusion fixing portion 1602 is formed on one side of the tube, and a stopper fixing portion 1606 is formed on the other side of the tube.

The holding protrusion fixing portion 1602 includes a horizontal portion coupled to the door latch connection portion installation groove 1162 of the housing 1100 and a vertical portion installed in the door latch connection portion through groove 1164 of the housing 1100. Accordingly, the holding protrusion fixing portion 1602 is fixed to the housing 1100.

The stopper fixing portion 1606 is fixed to the latch portion.

A stopper return spring 1605 is installed between the stopper 1604 and the stopper fixing portion 1606.

Accordingly, while positions of the holding protrusion fixing portion 1602 and the stopper fixing portion 1606 are fixed, when the holding protrusion 1601 is moved by the handle portion 1300, the stopper 1604 moves according thereto and physically operates the latch portion. Also, when the stopper 1604 returns to an original position due to the stopper return spring 1605, the holding protrusion 1601 moves according thereto and returns to an original position.

<Driving Portion>

The driving portion 1700 is shown in detail in FIGS. 17 to 20.

The driving portion 1700 includes a front case 1710, a rear case 1720 coupled to the front case 1710, a motor portion 1740 installed between the front case 1710 and the rear case 1720, and first, second, and third gear portions 1750, 1760, and 1770 which interconnect with the motor portion 1740.

Figure 18:
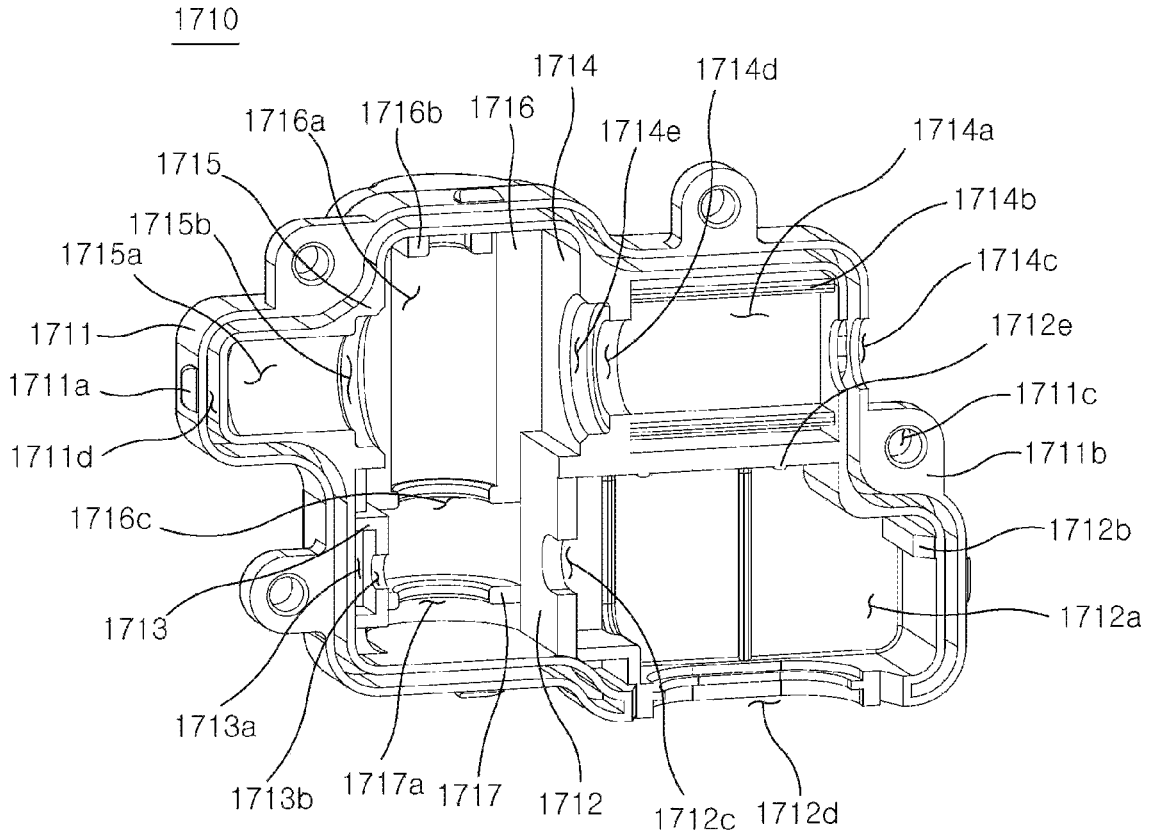
FIG. 18 is a rear perspective view illustrating a front case of the flush handle according to the first exemplary embodiment of the present invention.

The front case 1710 is shown in detail in FIG. 18.

The front case 1710 includes a front portion and a perimeter portion 1711 formed to protrude backward from a perimeter of the front portion. That is, the front case 1710 is formed to have an open rear.

A plurality of hook coupling protrusions 1711*a* are formed on an outer surface of the perimeter portion 1711 to protrude.

Screw coupling portions 1711*b* are formed on a top of a left side, a top of a right side, a bottom of the left side, and a bottom of the right side of the perimeter portion 1711.

The screw coupling portions 1711*b* are formed to have a plate shape.

A screw coupling groove 1711*c* is formed in the screw coupling portion 1711*b* to pass therethrough in the forward and backward direction.

The perimeter portion 1711 includes a sealing member insertion groove 1711*d* formed along a perimeter of the perimeter portion 1711 to have an open rear.

A sealing member 7130 installed in the sealing member insertion groove 1711*d* is formed of a rubber material.

The sealing member insertion groove 1711*d* is not formed in a power source portion through groove 1712*d* which will be described below.

The front case 1710 includes a motor partition 1712 formed on a bottom of a left side of the front case 1710, a guide portion partition 1714 formed above the motor partition 1712, and a bush partition 1713 formed on a bottom of a right side of the front case 1710.

The motor partition 1712, the guide portion partition 1714, and the bush partition 1713 are formed to protrude backward.

The motor partition 1712 includes a right wall, which extends upward from a bottom surface of the perimeter portion 1711, and an upper wall formed to extend leftward from a top end of the right wall.

A motor installation groove 1712*a* is formed by the motor partition 1712 and the perimeter portion 1711 to have an open rear.

A motor shaft support portion 1712*b* is formed on the perimeter portion 1711 located on a left side of the motor installation groove 1712*a* to protrude rightward.

A shaft of a driving motor 1741 which will be described below comes into contact with and is supported by a right surface of the motor shaft support portion 1712*b*.

A motor shaft through groove 1712*c* is formed on a right wall of the motor partition 1712 to have an open rear and pass therethrough in the lateral direction.

The shaft of the driving motor 1741 is installed in the motor shaft through groove 1712*c* from a rear to a front.

A plurality of protrusions 1712*e* are formed on the upper wall of the motor partition 1712 to protrude downward. Since fixing is easily performed and a contact surface is decreased due to the protrusion 1712*e* when the driving motor 1741 which will be described below is inserted into the motor installation groove 1712*a*, vibrations and noise are reduced.

The power source portion through groove 1712*d* is formed in the perimeter portion 1711 located below the motor installation groove 1712*a* to have an open rear and pass therethrough in the vertical direction.

The power source portion 1745 of the motor portion 1740 which will be described below is installed in the power source portion through groove 1712*d*.

The guide portion partition 1714 is formed to extend from a top surface of the perimeter portion 1711 to an upper surface of the motor partition 1712.

A guide portion installation groove 1714*a* is formed by the guide portion partition 1714, the upper surface of the motor partition 1712, and the perimeter portion 1711 to have an open rear.

Guide plates 1714*b* are formed on a top and bottom of the guide portion installation groove 1714*a* to protrude backward.

The guide plate 1714*b* is formed to be lengthwise in the lateral direction.

An opening member installation groove 1714*c* is formed in the perimeter portion 1711 located on a right side of the guide portion installation groove 1714*a* to have an open rear and pass therethrough in the lateral direction.

A lead screw installation groove 1714*d* is formed in the guide portion partition 1714 to have an open rear and pass therethrough in the lateral direction.

The lead screw installation groove 1714*d* is formed to be bent in an arc shape.

A second gear portion installation groove 1714*e* is formed on a right side of the guide portion partition 1714 to have an open rear and an open right side.

The second gear portion installation groove 1714*e* is formed to be bent in an arc shape.

A radius of the second gear portion installation groove 1714*e* is formed to be greater than a radius of the lead screw installation groove 1714*d*.

A left side of the second gear portion installation groove 1714*e* communicates with the lead screw installation groove 1714*d*.

That is, a step is formed between the second gear portion installation groove 1714*e* and the lead screw installation groove 1714*d*.

The bush partition 1713 includes an upper surface and a lower surface, which are formed to protrude leftward from the perimeter portion 1711, and a left surface which connects the upper surface to the lower surface.

A bush insertion groove 1713*a* is formed by the bush partition 1713 to have an open rear.

A worm shaft insertion groove 1713*b* is formed on the left surface of the bush partition 1713 to have an open rear and pass therethrough in the lateral direction.

A rear of a top of a right surface 1715 of the perimeter portion 1711 is formed to protrude rightward.

That is, a marginal space 1715*a* is formed in the rear of the top of the right surface 1715 to have an open rear and an open left side.

A cross section of the marginal space 1715*a* is formed to be similar or equal to a cross section of the lead screw installation groove 1714*d* of the guide portion partition 1714.

A second gear portion installation groove 1715*b* is formed on a left side of the marginal space 1715*a* to have an open rear and an open left side.

Across section of the second gear portion installation groove 1715*b* is formed to be similar or equal to a cross section of the second gear portion installation groove 1714*e* of the guide portion partition 1714.

That is, a step is formed between the marginal space 1715*a* and the second gear portion installation groove 1715*b*.

A first gear portion installation portion 1716 is formed on a top of the right side of the front case 1710 to protrude backward.

The first gear portion installation portion 1716 is formed to have a rectangular parallelepiped shape.

A first gear portion installation groove 1716*a* is formed in the first gear portion installation portion 1716 to be recessed forward to have an open rear. The first gear portion installation groove 1716*a* is formed to have a half cylinder shape in which a rotation axis is vertically placed.

A first gear shaft installation portion 1716*b* is formed above the first gear portion installation groove 1716*a* to protrude backward. A groove is formed in the first gear shaft installation portion 1716*b* so that a top of a first gear shaft 1751 which will be described below is installable from a rear to a front.

A first gear shaft through groove 1716*c* is formed at a bottom of the first gear portion installation groove 1716*a* to have an open rear and pass therethrough in the vertical direction.

A first gear shaft partition 1717 is formed on the bottom of the right side of the front case 1710 to protrude backward.

The first gear shaft partition 1717 is formed to have a plate shape.

A first gear shaft installation groove 1717*a* is formed in the first gear shaft partition 1717 to have an open rear and pass therethrough in the vertical direction.

The first gear shaft installation groove 1717*a* is disposed collinearly with the first gear shaft through groove 1716*c*.

Figure 19:
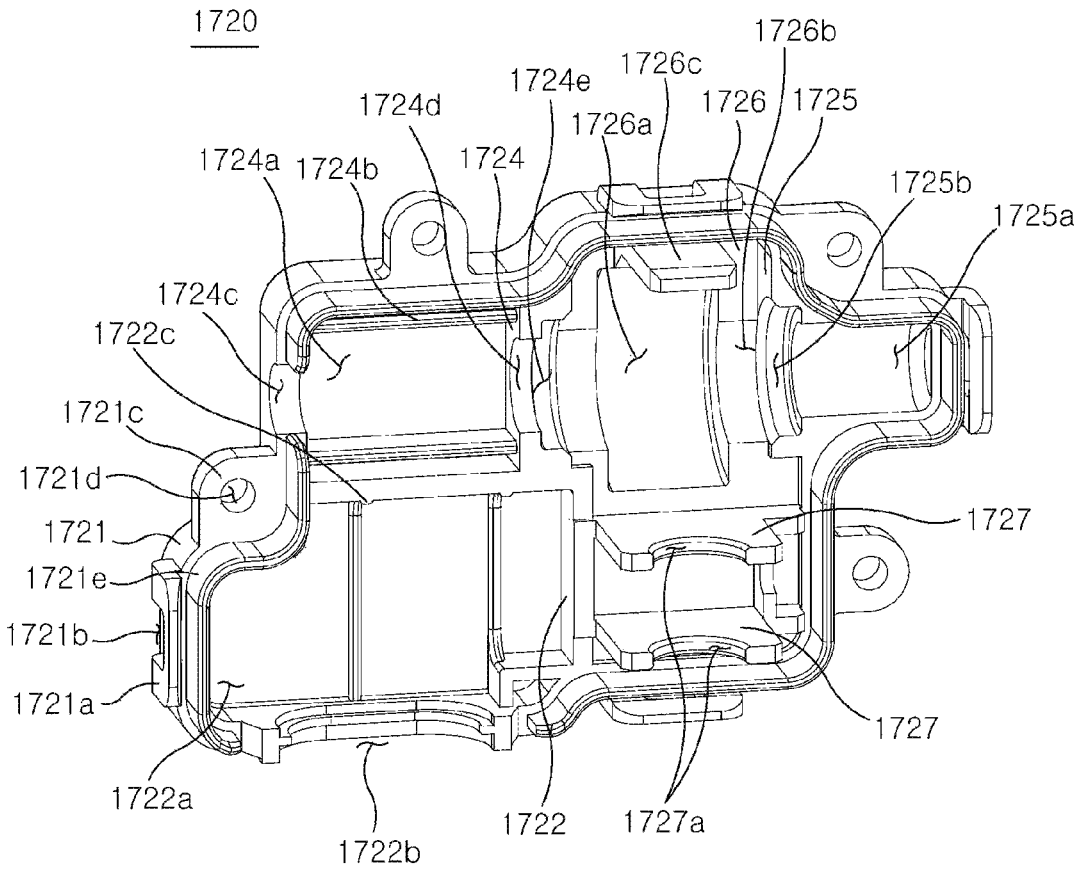
FIG. 19 is a front perspective view illustrating a rear case of the flush handle according to the first exemplary embodiment of the present invention.

The rear case 1720 is shown in detail in FIG. 19.

The rear case 1720 includes a rear portion and a perimeter portion 1721 formed to protrude forward from a perimeter of the rear portion. That is, the rear case 1720 is formed to have an open front.

A plurality of hook coupling portions 1721*a* are formed on an outer surface of the perimeter portion 1721 to be bent forward.

A hook coupling groove 1721*b* is formed in the hook coupling portion 1721*a* to pass therethrough in an inward and outward direction of the perimeter portion 1721.

The hook coupling protrusion 1711*a* of the front case 1710 is fastened to the hook coupling groove 1721*b*.

Screw coupling portions 1721*b* are formed on a top of a left side, a top of a right side, a bottom of the left side, and a bottom of the right side of the perimeter portion 1721.

The screw coupling portions 1721*c* are formed to have a plate shape.

A screw coupling groove 1721*d* is formed in the screw coupling portion 1721*c* to pass therethrough in the forward and backward direction.

The screw coupling groove 1721*d* of the rear case 1720 communicates with the screw coupling groove 1711*c* of the front case 1710 and is screw-coupled to the driving portion installation boss 1135 of the housing 1100.

The perimeter portion 1721 includes a sealing member blocking portion 1721*e* formed to be spaced apart from a perimeter of the perimeter portion 1721 and protrude backward.

The sealing member blocking portion 1721*e* is inserted into the sealing member insertion groove 1711*d* of the front case 1710.

The sealing member blocking portion 1721*e* is not formed in a power source portion through groove 1722*d* which will be described below.

That is, the sealing member 1730 is installed between the sealing member insertion groove 1711*d* of the front case 1710 and the sealing member blocking portion 1721*e* of the rear case 1720.

Accordingly, a phenomenon in which water or foreign substances flow into the front case 1710 and the rear case 1720 is prevented.

The rear case 1720 includes a motor partition 1722 formed on a bottom of a left side of the rear case 1720 and a guide portion partition 1724 formed above the motor partition 1722.

The motor partition 1722 and the guide portion partition 1724 are formed to protrude forward.

The motor partition 1722 includes a right wall, which extends upward from a bottom surface of the perimeter portion 1721, and an upper wall formed to extend leftward from a top end of the right wall.

A motor installation groove 1722*a* is formed by the motor partition 1722 and the perimeter portion 1721 to have an open front.

The power source portion through groove 1722*d* is formed in the perimeter portion 1721 located below the motor installation groove 1722*a* to have an open front and pass therethrough in the vertical direction.

A power source portion through groove 1722*b* communicates with the power source portion through groove 1712*d* of the front case 1710.

A plurality of protrusions 1722*c* are formed on the upper wall of the motor partition 1722 to protrude downward. Since fixing is easily performed and a contact surface is decreased due to the protrusion 1722*c* when the driving motor 1741 which will be described below is inserted into the motor installation groove 1722*a*, vibrations and noise are reduced.

The guide portion partition 1724 is formed to extend from a top surface of the perimeter portion 1721 to an upper surface of the motor partition 1722.

A guide portion installation groove 1724*a* is formed by the guide portion partition 1724, the upper surface of the motor partition 1722, and the perimeter portion 1721 to have an open front.

Guide plates 1724*b* are formed on a top and bottom of the guide portion installation groove 1724*a* to protrude forward.

The guide plate 1724*b* is formed to be lengthwise in the lateral direction.

The guide plate 1724*b* is formed to be spaced apart from the guide plate 1714*b* of the front case 1710 such that an insertion plate 1773*a* which will be described below is installed between the two guide plates 1714*b* and 1724*b* and slides in the lateral direction.

An opening member installation groove 1724*c* is formed in the perimeter portion 1721 located on a left side of the guide portion installation groove 1724*a* to have an open front and pass therethrough in the lateral direction.

A lead screw installation groove 1724*d* is formed in the guide portion partition 1724 to have an open front and pass therethrough in the lateral direction.

The lead screw installation groove 1724*d* is formed to be symmetrical to the lead screw installation groove 1714*d* of the front case 1710 in the forward and backward direction.

A second gear portion installation groove 1724*e* is formed on a right side of the guide portion partition 1724 to have an open front and an open right side.

The second gear portion installation groove 1724*e* is formed to be symmetrical to the second gear portion installation groove 1714*e* of the front case 1710 in the forward and backward direction.

That is, a step is formed between the second gear portion installation groove 1724*e* and the lead screw installation groove 1724*d*.

A front of a top of a right surface 1725 of the perimeter portion 1721 is formed to protrude rightward.

That is, a marginal space 1725*a* is formed in the front of the top of the right surface 1725 to have an open front and an open right side.

The marginal space 1725*a* is formed to be symmetrical to the marginal space 1715*a* of the front case 1710 in the forward and backward direction.

A second gear portion installation groove 1725*b* is formed on a left side of the marginal space 1725*a* to have an open front and an open left side.

The second gear portion installation groove 1725*b* is formed to be symmetrical to the second gear portion installation groove 1715*b* of the front case 1710 in the forward and backward direction. That is, a step is formed between the marginal space 1725*a* and the second gear portion installation groove 1725*b*.

A second gear portion installation portion 1726 is formed on a top of the right side of the rear case 1720 to protrude backward.

The second gear portion installation portion 1726 is formed to have a rectangular parallelepiped shape.

A second gear portion installation groove 1726*a* is formed in the second gear portion installation portion 1726 to be recessed backward to have an open front. The second gear portion installation groove 1726*a* is formed to have a half cylinder shape in which a rotation axis is laterally placed.

Second gear portion auxiliary installation grooves 1726*b* are formed on a left side and a right side of the second gear portion installation groove 1726*a* to be recessed backward.

The second gear portion auxiliary installation groove 1726*b* is formed to have a half cylinder shape in which a rotation axis is laterally placed.

A radius of the second gear portion auxiliary installation groove 1726*b* is formed to be smaller than a radius of the second gear portion installation groove 1726*a*.

A first gear shaft blocking plate 1726*c* is formed above the second gear portion installation groove 1726*a* to protrude forward.

The first gear shaft blocking plate 1726*c* is installed to block a rear of the first gear shaft installation portion 1716*b* of the front case 1710.

Two first gear shaft partitions 1727 are formed on the bottom of the right side of the rear case 1720 to protrude forward.

The first gear shaft partitions 1727 are formed to have a plate shape.

A first gear shaft installation groove 1727*a* is formed in the first gear shaft partition 1727 to have an open front and pass therethrough in the vertical direction.

The two first gear shaft partitions 1727 are formed to be spaced apart from each other in the vertical direction.

The first gear shaft partition 1727 formed above is disposed to come into contact with a bottom end of the first gear portion installation portion 1716 of the front case 1710, and the first gear shaft partition 1727 formed below is disposed to come into contact with the first gear shaft partition 1717 of the front case 1710.

Figure 20:
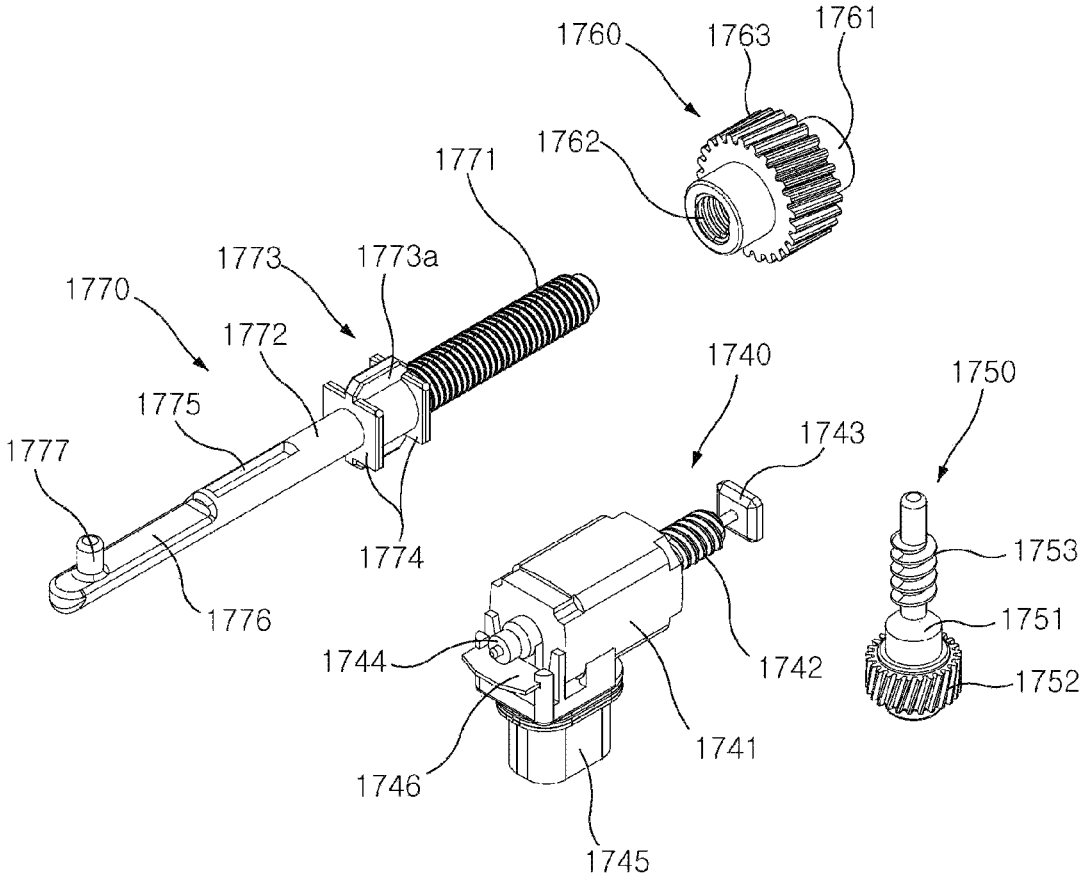
FIG. 20 is a front exploded perspective view illustrating a motor portion, a first gear portion, a second gear portion, and a third gear portion of the flush handle according to the first exemplary embodiment of the present invention.

The motor portion 1740 and the first, second, and third gear portions 1750, 1760, and 1770 are shown in detail in FIG. 20.

The motor portion 1740 includes the driving motor 1741, a first worm gear 1742 installed on a right shaft of the driving motor 1741, and the power source portion 1745 installed on a bottom of a left side of the driving motor 1741.

A worm shaft bush 1743 is installed on an end of the right shaft of the driving motor 1741.

A front of the worm shaft bush 1743 is installed in the bush insertion groove 1713*a* of the front case 1710 and a rear thereof is installed in the rear case 1720 formed opposite the bush insertion groove 1713*a* to reduce vibrations of the driving motor 1741.

A motor shaft magnet 1744 is installed on an end of a left shaft of the driving motor 1741.

A power cable is connected to the power source portion 1745 from bottom to top.

An encoder 1746 is installed on the power source portion 1745 to be placed below the left shaft of the driving motor 1741.

The number of rotations of the driving motor 1741 may be sensed and controlled using the encoder 1746.

The driving motor 1741 is inserted between the motor installation groove 1712*a* of the front case 1710 and the motor installation groove 1722*a* of the rear case 1720.

The right shaft of the driving motor 1741 is installed in the motor shaft through groove 1712*c* of the front case 1710, and the first worm gear 1742 is disposed on a right side of the motor partition 1712 of the front case 1710.

The power source portion 1745 is installed between the power source portion through groove 1712*d* of the front case 1710 and the power source portion through groove 1722*b* of the rear case 1720.

Also, a front of the power source portion 1745 is installed in the power source portion installation groove 1127 of the housing 1100 and protrudes below the housing 1100.

A rubber packing is installed above the power source portion 1745 so as to prevent foreign substances from flowing inward through the power source portion through grooves 1712*d* and 1722*b*.

The first gear portion 1750 is disposed in front of a right side of the motor portion 1740.

The first gear portion 1750 includes the first gear shaft 1751 placed in the vertical direction, a first helical gear 1752 formed below the first gear shaft 1751 and engaged with the first worm gear 1742, and a second worm gear 1753 formed above the first gear shaft 1751.

The first helical gear 1752 and the second worm gear 1753 share the first gear shaft 1751 in common and are rotated at the same time.

A top end of the first gear shaft 1751 is installed between the first gear shaft installation portion 1716*b* of the front case 1710 and the first gear shaft blocking plate 1726*c* of the rear case 1720.

A bottom end of the first gear shaft 1751 is installed between the first gear shaft partition 1717 of the front case 1710 and the first gear shaft partition 1727 of the rear case 1720.

The second gear portion 1760 is disposed behind the second worm gear 1753.

The second gear portion 1760 includes the second gear shaft 1761 placed in the lateral direction, a second helical gear 1763 formed on an outer surface of the second gear shaft 1761 and engaged with the second worm gear 1753, and a female screw portion 1762 formed inside the second gear shaft 1761.

A left side of the second gear shaft 1761 is installed between the second gear portion installation groove 1714*e* of the front case 1710 and the second gear portion installation groove 1724*e* of the rear case 1720, and a right side of the second gear shaft 1761 is installed between the second gear portion installation groove 1715*b* of the front case 1710 and the second gear portion installation groove 1725*b* of the rear case 1720.

Accordingly, the second gear shaft 1761 is installed not to move in the lateral direction.

The third gear portion 1770 is disposed on a left side of the second gear portion 1760.

The third gear portion 1770 includes a lead screw 1771 engaged with the female screw portion 1762 of the second gear portion 1760, a guide portion 1773 installed on a left side of the lead screw 1771, and the opening member 1772 formed on a left side of the guide portion 1773.

A right side of the lead screw 1771 is installed between the marginal space 1715*a* of the front case 1710 and the marginal space 1725*a* of the rear case 1720.

Figure 35:
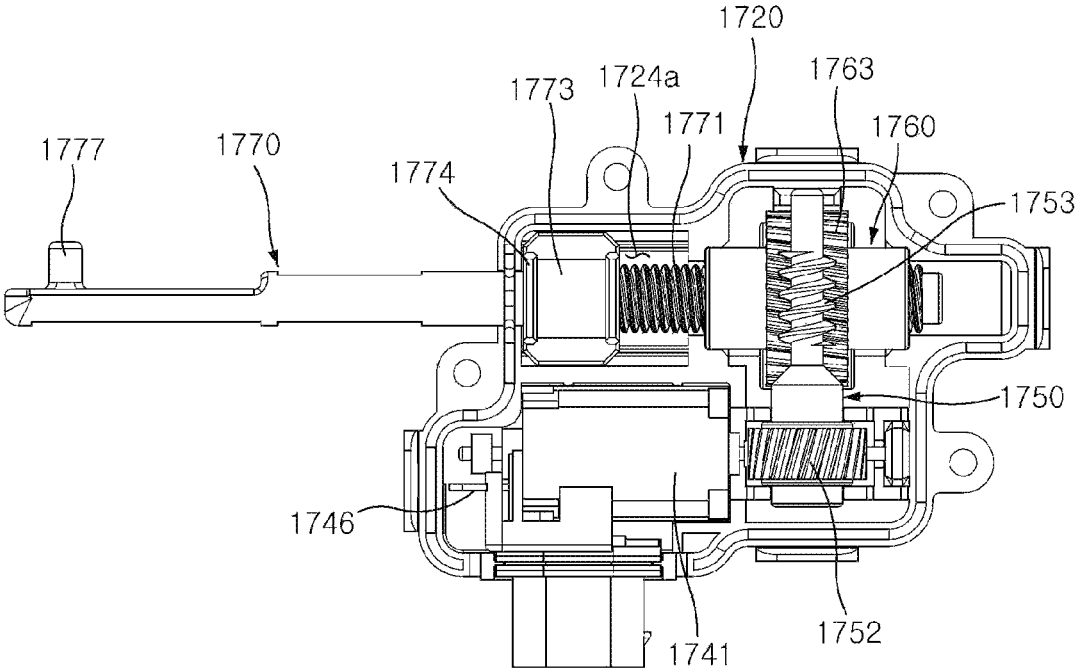
FIG. 35 is a front view illustrating a state of the driving portion while the flush handle, from which the front case is eliminated, according to the first exemplary embodiment of the present invention is inserted.

When the lead screw 1771 is in an initial state as shown in FIG. 35, a right end of the lead screw 1771 is disposed to be spaced apart from right inner walls of the marginal spaces 1715*a* and 1725*a*.

Figure 36:
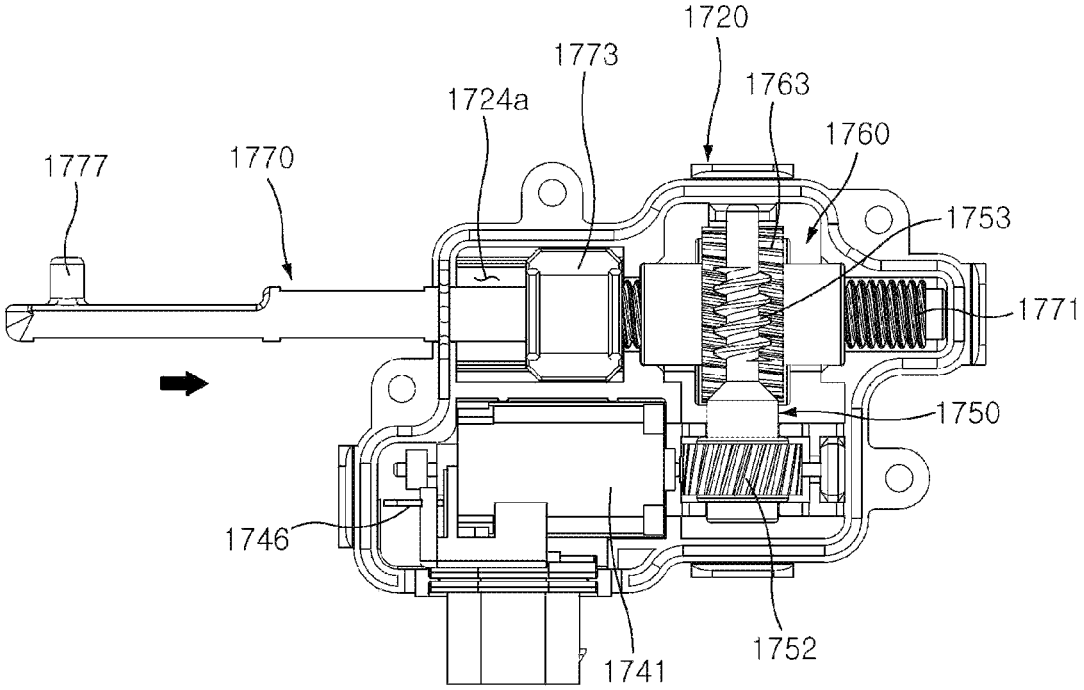
FIG. 36 is a front view illustrating a state of the driving portion while the flush handle, from which the front case is eliminated, according to the first exemplary embodiment of the present invention is withdrawn.

The marginal spaces 1715*a* and 1725*a* are formed so that the lead screw 1771 and the right inner walls of the marginal spaces 1715*a* and 1725*a* do not interfere with each other when the lead screw 1771 moves maximally rightward as shown in FIG. 36.

The guide portion 1773 is installed on a left side of a rotation shaft of the lead screw 1771.

The lead screw 1771 is installed to be horizontally movable with respect to the guide portion 1773.

The guide portion 1773 is formed to move along the lead screw 1771 in the lateral direction.

The insertion plates 1773*a* are formed on a top and bottom of the guide portion 1773 to protrude.

The insertion plate 1773*a* is formed to be lengthwise in the lateral direction.

Holding plates 1774 are formed on an outer surface of the left side and an outer surface of a right side of the guide portion 1773 to protrude outward.

The holding plates 1774 are formed to be quadrangular plates.

The holding plates 1774 are formed to be held by the left side or a right side of the guide portion installation groove 1714*a* of the front case 1710 and the guide portion installation groove 1724*a* of the rear case 1720.

When the lead screw 1771 is in the initial state as shown in FIG. 35, the holding plate 1774 formed on a left side is held by the left sides of the guide portion installation grooves 1714*a* and 1724*a*. When the lead screw 1771 maximally moves rightward as shown in FIG. 36, the holding plate 1774 formed on a right side is held by the right sides of the guide portion installation grooves 1714*a* and 1724*a*.

Due to the guide portion 1773, as the lead screw 1771 is rotated, the guide portion 1773 is not rotated according thereto and slides in the lateral direction.

The opening member 1772 is disposed collinearly with the lead screw 1771 in the lateral direction.

The opening member 1772 is formed to have a cylindrical shape of which a rotation axis is placed in the lateral direction.

The opening member 1772 is installed between the opening member installation groove 1714*c* of the front case 1710 and the opening member installation groove 1724*c* of the rear case 1720 and protrudes outward from the front case 1710 and the rear case 1720.

A slimming groove 1775 is formed on a left side of the opening member 1772 to have an open top and an open bottom. A weight of the opening member 1772 is reduced by the slimming groove 1775.

A handle portion rotation groove 1776 is formed on the left side of the opening member 1772 to have a flat top.

A bottom surface of the interconnection member 1323 of the handle portion 1300 comes into contact with a top of the handle portion rotation groove 1776. Accordingly, the left side of the opening member 1772 laterally slides along the bottom surface of the interconnection member 1323 of the handle portion 1300.

The handle portion holding protrusion 1777 is formed on an end of the left side of the opening member 1772 to protrude upward.

The handle portion holding protrusion 1777 is inserted into the interconnection groove 1323*a* of the handle portion 1300.

The handle portion holding protrusion 1777 is formed to be inserted into a right side of the interconnection groove 1323*a* to come into contact with an inner surface of the interconnection groove 1323*a* in the initial state.

Subsequently, a principal of operation of the driving portion 1700 will be described with reference to FIG. 35.

When the driving motor 1741 is operated, the first worm gear 1742 is rotated.

When the first helical gear 1752 engaged with the first worm gear 1742 is rotated as the first worm gear 1742 is rotated, the second worm gear 1753 which shares the first gear shaft 1751 with the first helical gear 1752 in common is also rotated.

When the second helical gear 1763 engaged with the second worm gear 1753 is rotated as the second worm gear 1753 is rotated, the female screw portion 1762 which shares the second gear shaft 1761 with the second helical gear 1763 in common is also rotated.

When the lead screw 1771 engaged with the female screw portion 1762 moves along a screw portion of the female screw portion 1762 as the female screw portion 1762 is rotated, the lead screw 1771 slides in the lateral direction such that an entirety of the third gear portion 1770 slides in the lateral direction.

<Key Module>

Figure 21:
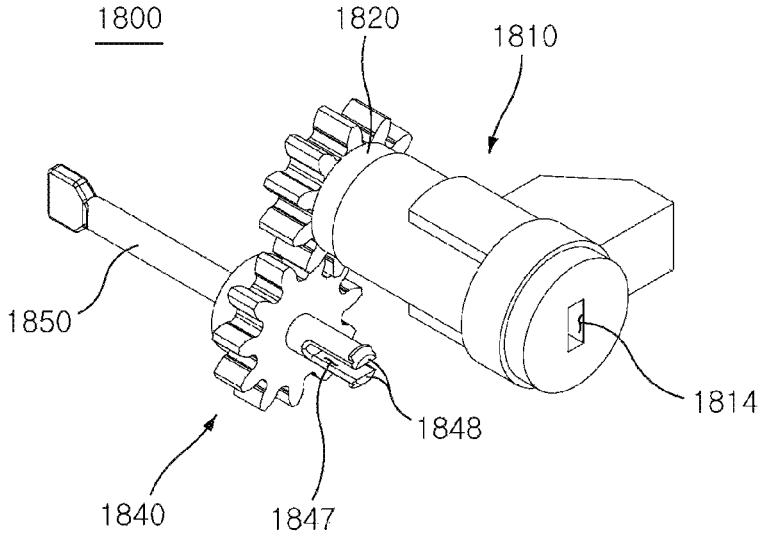
FIG. 21 is a front perspective view illustrating a key module of the flush handle according to the first exemplary embodiment of the present invention.
Figure 22:
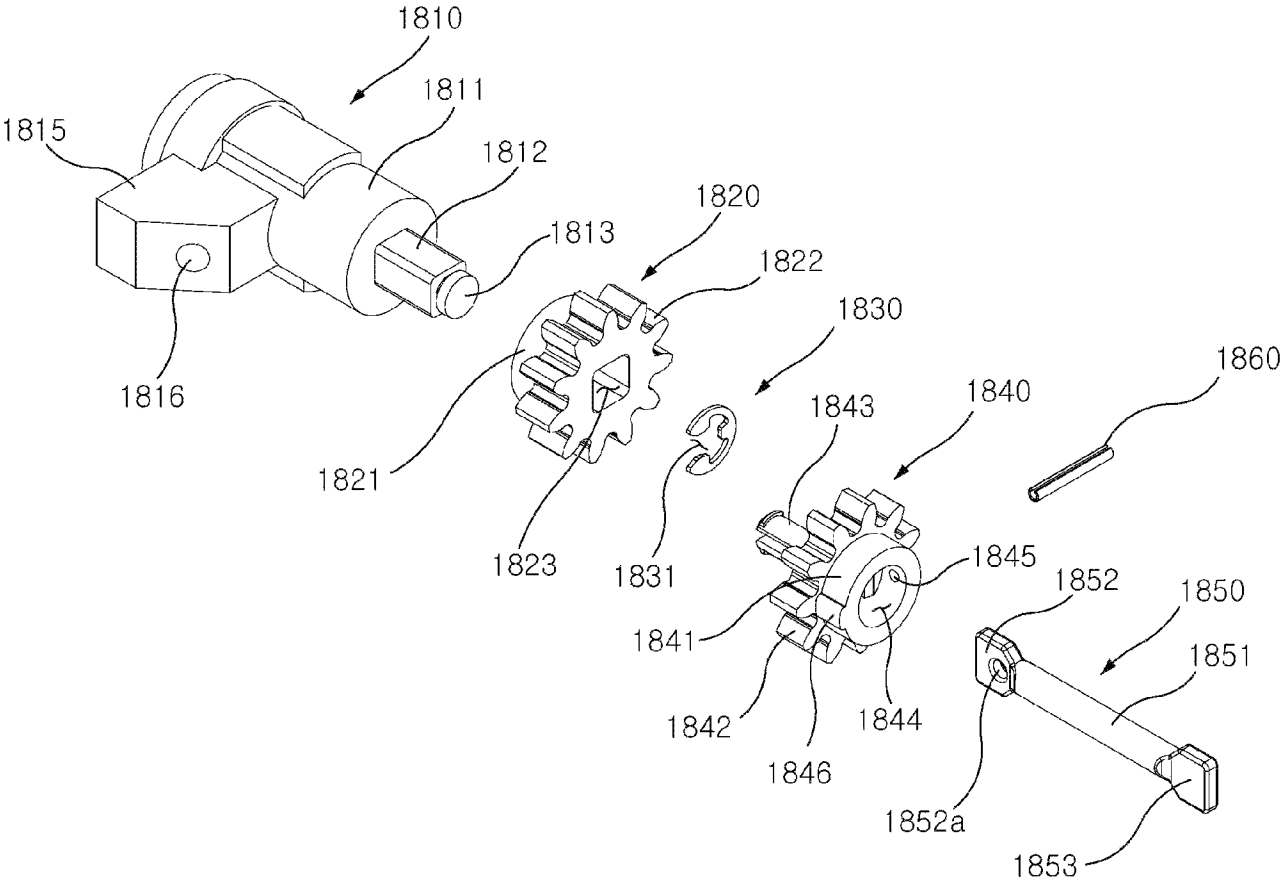
FIG. 22 is a rear exploded perspective view illustrating the key module of the flush handle according to the first exemplary embodiment of the present invention.

The key module 1800 is shown in detail in FIGS. 21 and 22.

The key module 1800 includes the key cylinder 1810 into which a key is directly inserted, a first key gear portion 1820 installed behind the key cylinder 1810, and the second key gear portion 1840 which interconnects with the first key gear portion 1820.

The key cylinder 1810 includes a key insertion portion 1811 in front of which a key insertion groove 1814 is formed, a first key gear installation portion 1812 formed to protrude behind the key insertion portion 1811, and a fixing clip installation portion 1813 formed to protrude behind the first key gear installation portion 1812.

The key insertion portion 1811 is formed to have a cylindrical shape.

The key insertion groove 1814 is disposed to communicate with the handle portion through groove 1101 after the key cylinder 1810 is installed in the key module installation groove 1183 of the housing 1100.

Accordingly, after the handle portion 1300 is withdrawn, the user may stick a key into the key insertion groove 1814 through a gap between the handle portion 1300 and the housing 1100 and manipulate the key cylinder 1810.

The first key gear installation portion 1812 is formed to have a square column shape.

The first key gear installation portion 1812 and a part of the key insertion portion 1811, in which the key insertion groove 1814 is formed, are formed to be connected to each other and be rotatable in the key cylinder 1810. Accordingly, when the user sticks the key into the key insertion portion 1811 and rotates the key, the first key gear installation portion 1812 also rotates.

The fixing clip installation portion 1813 is formed to have a cylindrical shape.

A groove, into which a fixing clip 1830 is inserted, is formed between the key gear installation portion 1812 and the fixing clip installation portion 1813.

A screw coupling portion 1815 is formed on a right side of the key cylinder 1810 to protrude.

A screw coupling groove 1816 is formed in the screw coupling portion 1815 to allow a screw, which passes through the key module fastening groove 1184 of the housing 1100, to be inserted thereinto.

Accordingly, the key cylinder 1810 is screw-coupled to the housing 1100.

The first key gear portion 1820 includes a first key gear shaft 1821 placed in the forward and backward direction and a first key gear 1822 formed behind an outer surface of the first key gear shaft 1821.

A key cylinder insertion groove 1823 is formed in the first key gear shaft 1821 to pass therethrough in the forward and backward direction.

The key cylinder insertion groove 1823 is formed to have a square column shape.

The first key gear installation portion 1812 of the key cylinder 1810 is inserted into the key cylinder insertion groove 1823.

An opening portion is formed on one side of the fixing clip 1830 such that the first key gear portion 1820 may be inserted into the first key gear installation portion 1812 and then the fixing clip 1830 may be inserted into a groove formed between the first key gear installation portion 1812 and the fixing clip installation portion 1813. A rear of the first key gear portion 1820 is blocked by the fixing clip 1830.

Accordingly, when the first key gear installation portion 1812 is rotated, the key gear portion 1820 does not idle and rotates therewith.

The second key gear portion 1840 includes a second key gear shaft 1841, a second key gear 1842 formed in front of an outer surface of the second key gear shaft 1841, and a coupling portion 1843 formed to protrude in front of the second key gear 1842.

A connection rod insertion groove 1844 is formed in the second key gear shaft 1841 to have an open rear.

A pin groove 1845 is formed on a left side of a rear of the second key gear shaft 1841 to pass therethrough in an inward and outward direction of the second key gear shaft 1841. The pin groove 1845 communicates with the connection rod insertion groove 1844.

A pin installation portion 1846 is formed on a right side of the rear of the second key gear shaft 1841 to protrude rightward.

A groove is formed on a left side of the pin installation portion 1846 to be collinear with the pin groove 1845. Accordingly, a pin 1860 is installed rightward and leftward through the pin groove 1845 such that a right side thereof is blocked by the pin installation portion 1846.

A connection rod 1850 which will be described below is installed on the pin 1860.

The second key gear 1842 is formed to be engaged with the first key gear 1822.

The coupling portion 1843 is formed to have a cylindrical shape.

A separation groove 1847 is formed in the coupling portion 1843 so as to space a top and bottom thereof apart from each other. Accordingly, the coupling portion 1843 may be elastically deformed.

Holding protrusions 1848 are formed in front of the top and bottom of the coupling portion 1843 to protrude outward.

After the coupling portion 1843 is inserted into the second key gear portion installation groove 1186 of the housing 1100, when the holding protrusion 1848 is inserted into the second key gear portion coupling groove 1187, the coupling portion 1843 and the housing 1100 are hook-coupled.

The connection rod 1850 includes a connection rod shaft 1851 formed lengthwise in the forward and backward direction, a first end 1852 formed in front of the connection rod shaft 1851, and a second end 1853 formed behind the connection rod shaft 1851.

The first end 1852 and the second end 1853 are formed to have a plate shape.

A first end groove 1852*a* through which the pin 1860 is passable is formed in the first end 1852.

When the first end 1852 of the connection rod 1850 is inserted into the connection rod insertion groove 1844 before installing the pin 1860 and the pin 1860 is installed through the first end groove 1852*a*, the second key gear portion 1840 and the connection rod 1850 are pin-coupled.

The second end 1853 is connected to the latch portion capable of fastening or unfastening the door of the vehicle.

<Method of Opening Door Using Door Latch Connection Portion>

Hereinafter, a method of opening the door of the vehicle using the door latch connection portion 1600 will be described with reference to FIGS. 25 to 27 and 27 to 31.

Figure 25:
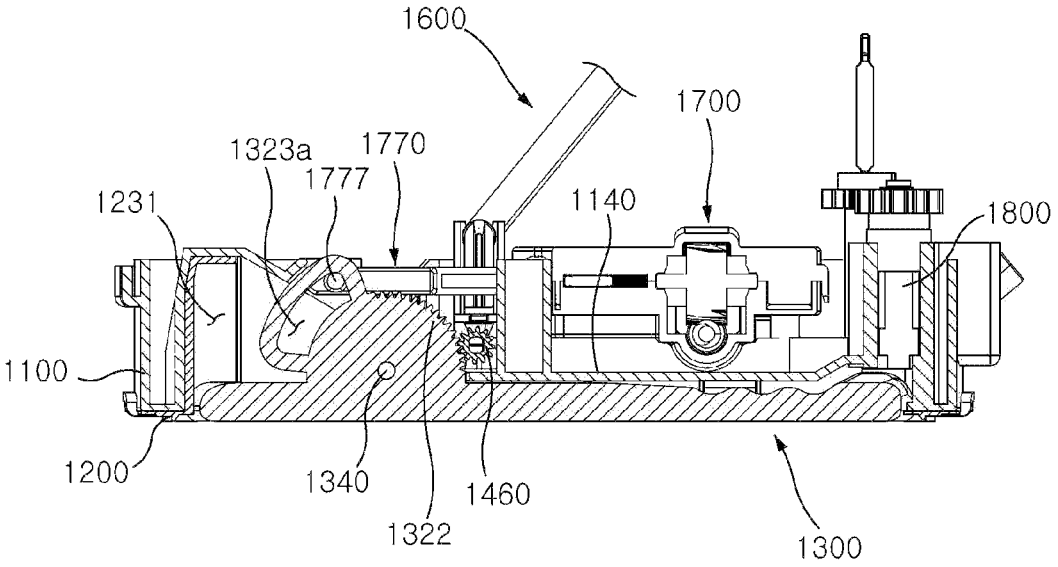
FIG. 25 is a cross-sectional view illustrating an insertion state of the flush handle according to the first exemplary embodiment of the present invention.

FIG. 25 is a view illustrating an initial state in which the handle portion 1300 is inserted.

Figure 27:
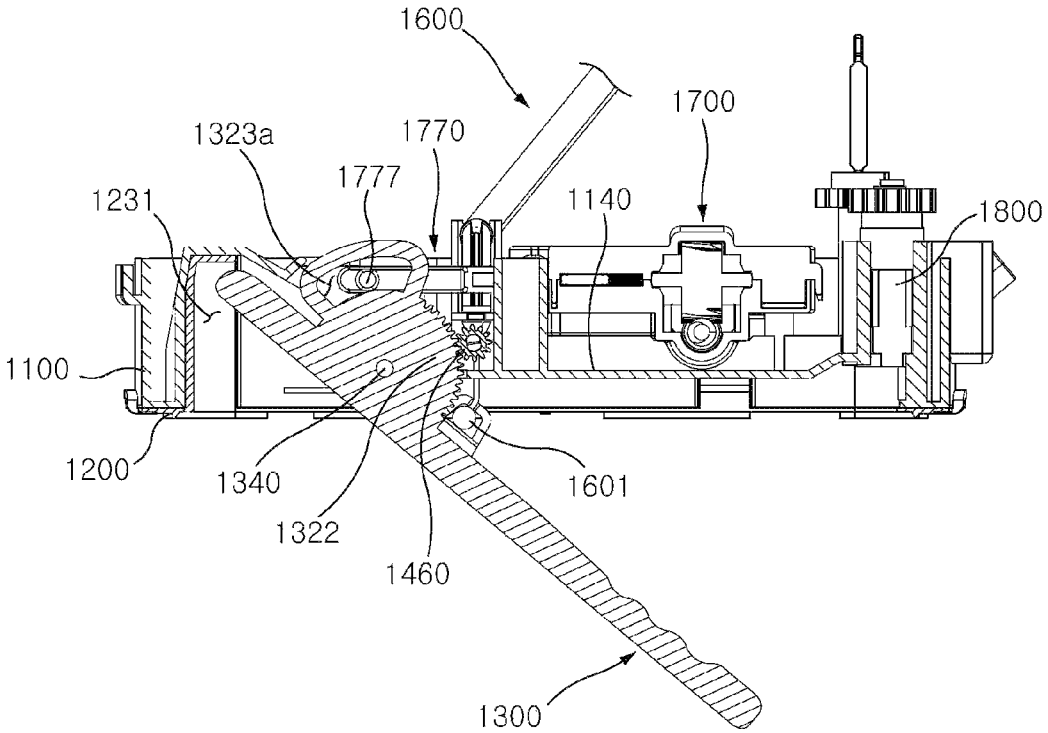
FIG. 27 is a cross-sectional view illustrating a pulled state of the flush handle according to the first exemplary embodiment of the present invention.
Figure 28:
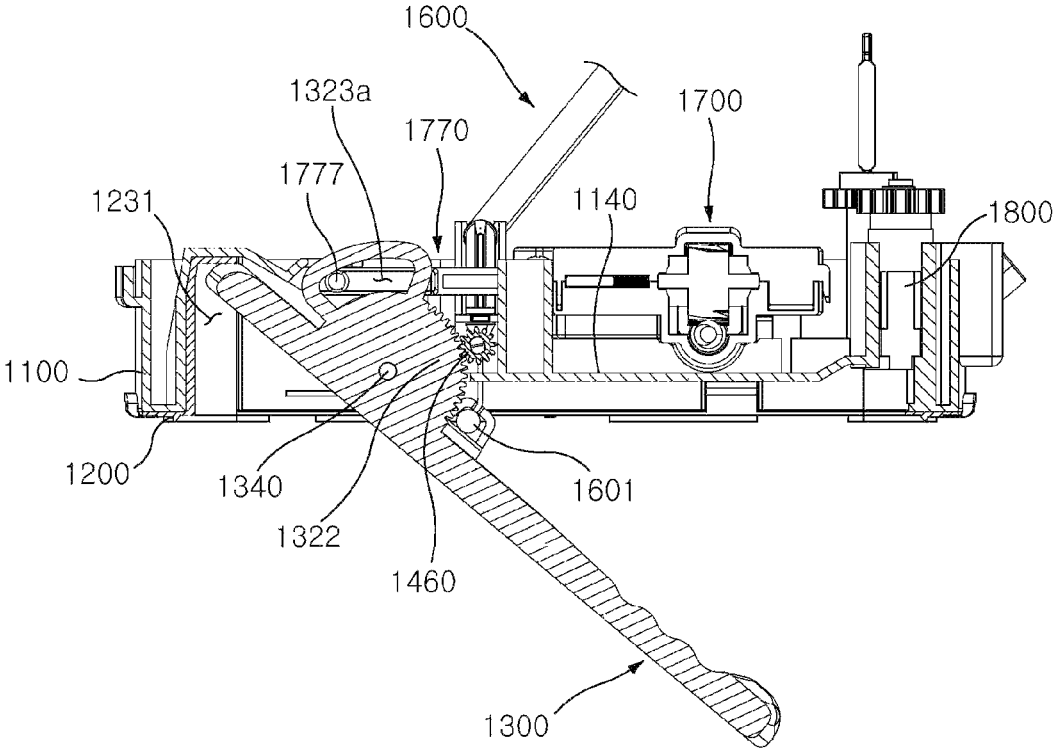
FIG. 28 is a cross-sectional view illustrating a state in which the flush handle according to the first exemplary embodiment of the present invention is manually withdrawn and pulled.
Figure 29:
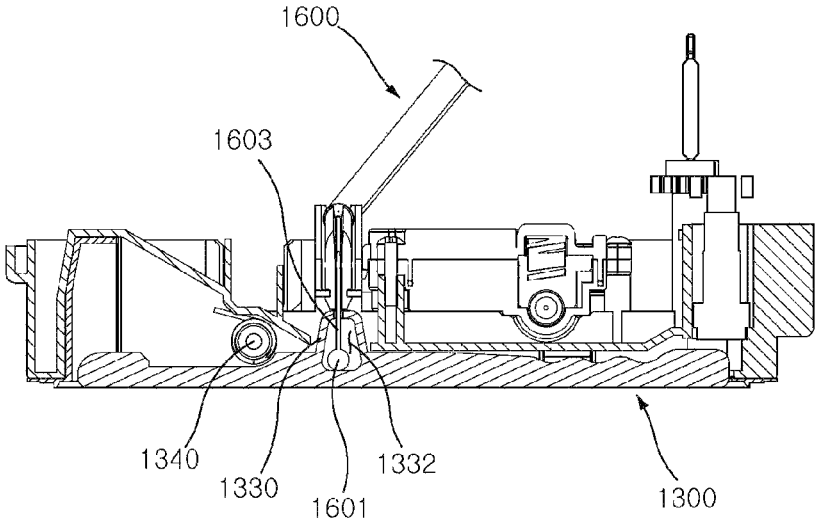
FIG. 29 is a cross-sectional view illustrating a state of a door latch connection portion while the flush handle according to the first exemplary embodiment of the present invention is inserted.
Figure 30:
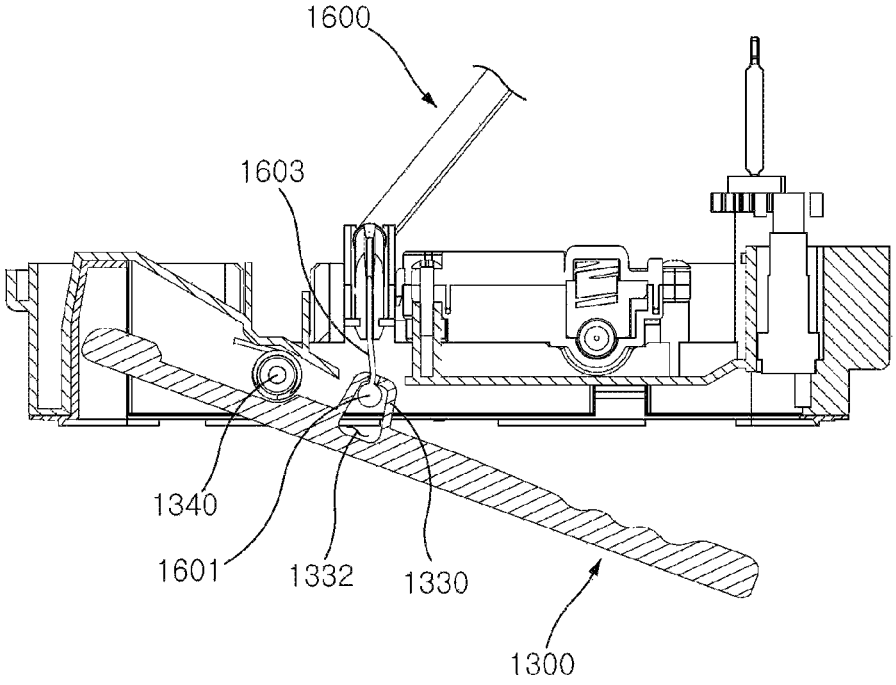
FIG. 30 is a cross-sectional view illustrating a state of the door latch connection portion while the flush handle according to the first exemplary embodiment of the present invention is withdrawn by the driving portion.
Figure 31:
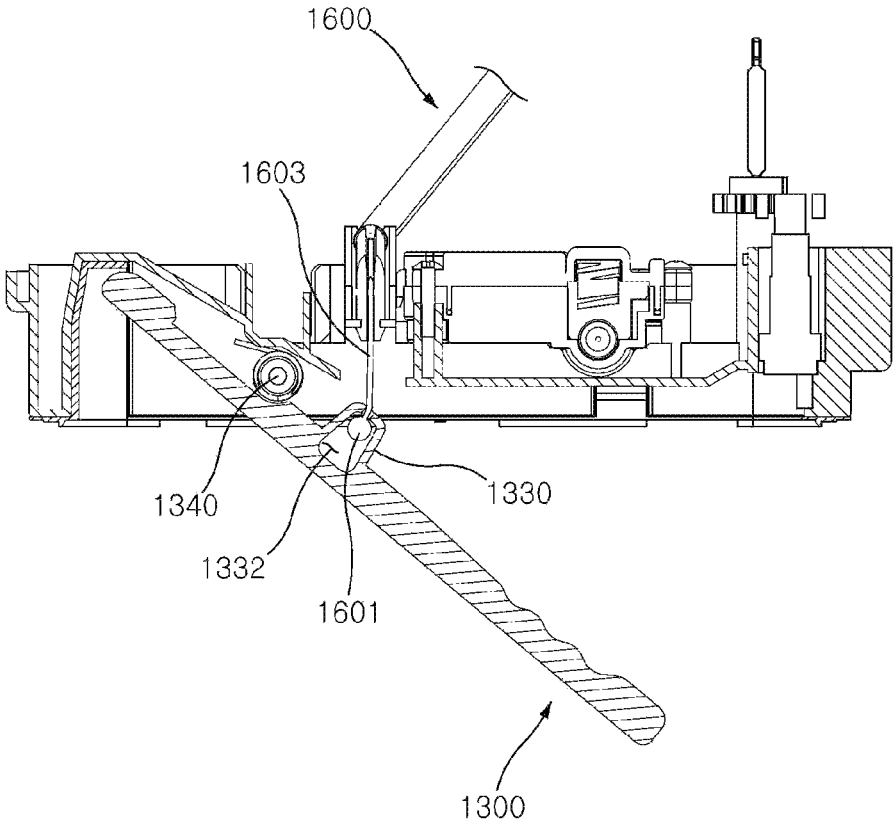
FIG. 31 is a cross-sectional view illustrating a state of the door latch connection portion while the flush handle according to the first exemplary embodiment of the present invention is pulled.

Here, as shown in FIG. 27, the holding protrusion 1601 of the door latch connection portion 1600 is located in front of the door latch connection portion insertion groove 1333.

When a signal for withdrawing the handle portion 1300 is input to a control portion (not shown), the driving portion 1700 is operated by the control portion.

Figure 26:
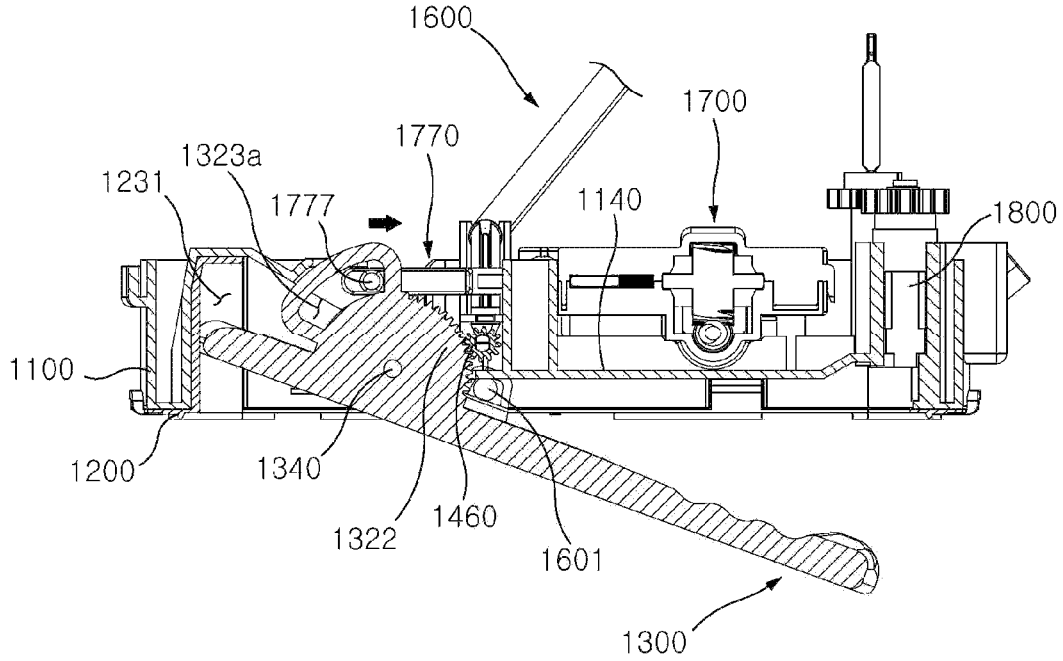
FIG. 26 is a cross-sectional view illustrating a withdrawn state, by the driving portion, of the flush handle according to the first exemplary embodiment of the present invention.

When the driving portion 1700 operates, as shown in FIG. 26, the handle portion holding protrusion 1777 of the driving portion 1700 pulls the interconnection member 1323 of the handle portion 1300 in a rightward direction and the interconnection member 1323 and an entirety of the handle portion 1300 including the interconnection member 1323 rotate clockwise on the rotating shaft 1340.

When the driving motor 1741 rotates a certain number of rotations or more, the driving motor 1741 stops operation and the handle portion 1300 rotates by a certain angle or more as shown in FIG. 26 such that a space between the right side of the handle portion 1300 and the housing 1100 is increased by a certain distance or more. Here, the number of rotations of the driving motor 1741 is controlled using the encoder 1746.

Here, as shown in FIG. 26, the handle portion 1300 rotates unless the holding protrusion 1601 of the door latch connection portion 1600 is pulled.

Subsequently, as shown in FIG. 27, when the user inserts his or her hand into the right side of the handle portion 1300 and pulls the handle portion 1300, the handle portion 1300 rotates clockwise on the rotating shaft 1340.

The handle portion 1300 may rotate until the left side of the handle portion 1300 reaches a rear of the rotation-guide groove 1231 of the bumper member 1200.

Here, the handle portion 1300 is rotated without being interfered with the handle portion holding protrusion 1777 due to a shape of the interconnection groove 1323*a*.

Here, as shown in FIG. 27, the holding protrusion 1601 of the door latch connection portion 1600 is pulled clockwise. Accordingly, the latch portion, which interconnects with the door latch connection portion 1600, operates such that the door of the vehicle is unfastened and opened.

Here, the latch portion may be manually operated or electrically powered.

A method of operating the electrically-powered latch portion has been disclosed in detail in Korean Patent Registration No. 10-2059334 or Korean Patent Registration No. 10-2059335.

<Method of Opening Door Using Sensor>

Hereinafter, a method of opening the door of the vehicle using the sensor 1540 will be described with reference to FIGS. 25 to 27 and 32 to 34.

FIG. 25 is a view illustrating an initial state in which the handle portion 1300 is inserted.

Figure 32:
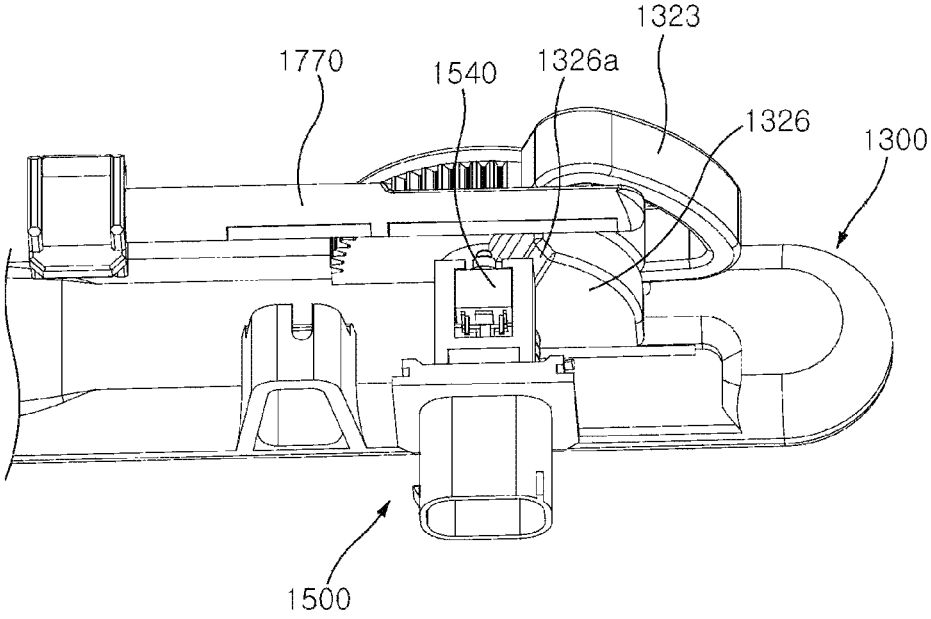
FIG. 32 is a rear perspective view illustrating a state of a sensor while the flush handle according to the first exemplary embodiment of the present invention is inserted.

Here, as shown in FIG. 32, the sensor 1540 deviates from the sensor push portion 1326 of the handle portion 1300.

When a signal for withdrawing the handle portion 1300 is input to the control portion (not shown), the driving portion 1700 is operated by the control portion.

When the driving portion 1700 operates, as shown in FIG. 26, the handle portion holding protrusion 1777 of the driving portion 1700 pulls the interconnection member 1323 of the handle portion 1300 in a rightward direction and the interconnection member 1323 and an entirety of the handle portion 1300 including the interconnection member 1323 rotate clockwise on the rotating shaft 1340.

When the driving motor 1741 rotates a certain number of rotations or more, the driving motor 1741 stops operation and the handle portion 1300 rotates by a certain angle or more as shown in FIG. 26 such that a space between the right side of the handle portion 1300 and the housing 1100 is increased by a certain distance or more. Here, the number of rotations of the driving motor 1741 is controlled using the encoder 1746.

Figure 33:
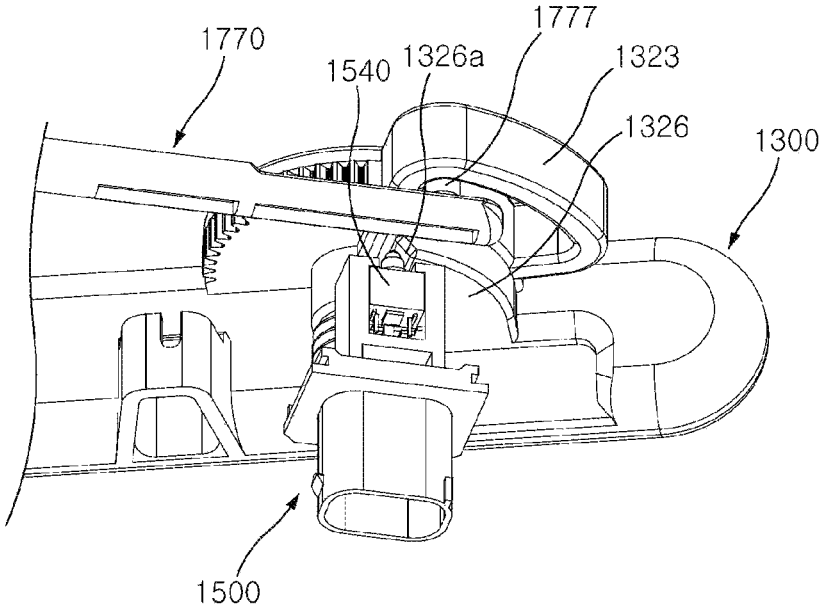
FIG. 33 is a rear perspective view illustrating a state of the sensor while the flush handle according to the first exemplary embodiment of the present invention is withdrawn by the driving portion.

Here, as shown in FIG. 33, the handle portion 1300 rotates unless the sensor push portion pushes the sensor 1540.

Subsequently, as shown in FIG. 27, when the user inserts his or her hand into the right side of the handle portion 1300 and pulls the handle portion 1300, the handle portion 1300 rotates clockwise on the rotating shaft 1340.

The handle portion 1300 may rotate until the left side of the handle portion 1300 reaches the rear of the rotation-guide groove 1231 of the bumper member 1200.

Here, the handle portion 1300 is rotated without interfering with the handle portion holding protrusion 1777 due to the shape of the interconnection groove 1323*a*.

Figure 34:
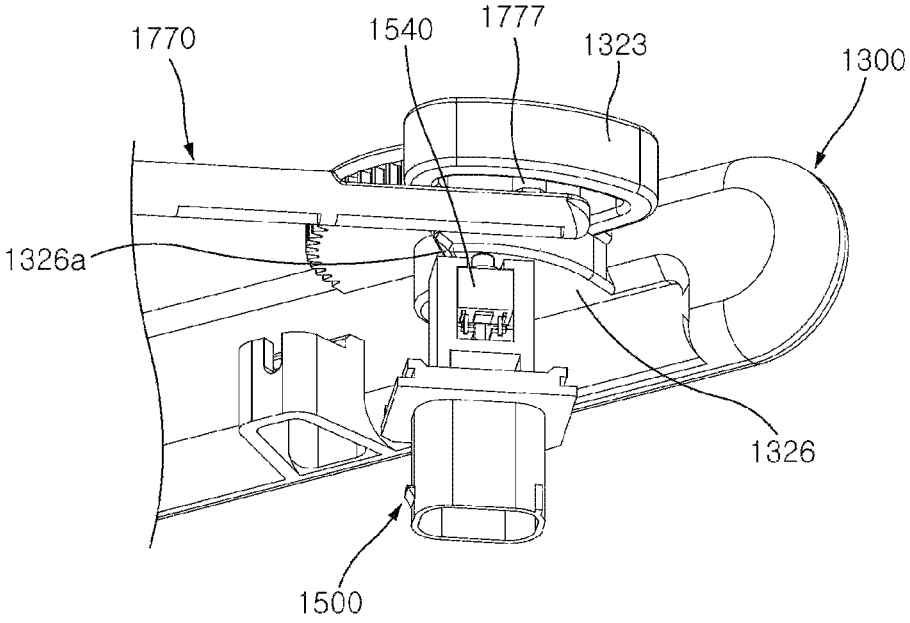
FIG. 34 is a rear perspective view illustrating a state of the sensor while the flush handle according to the first exemplary embodiment of the present invention is pulled.

Here, as shown in FIG. 34, the sensor push portion 1326 pushes the top of the sensor 1540, and the sensor 1540 sends a signal to the control portion. Subsequently, the electrically-powered latch portion is operated by the control portion such that the door of the vehicle is unfastened and opened.

<Method of Manually Withdrawing Handle Portion>

Hereinafter, a method of manually withdrawing the handle portion 1300 will be described with reference to FIGS. 23 and 24.

Figure 23:
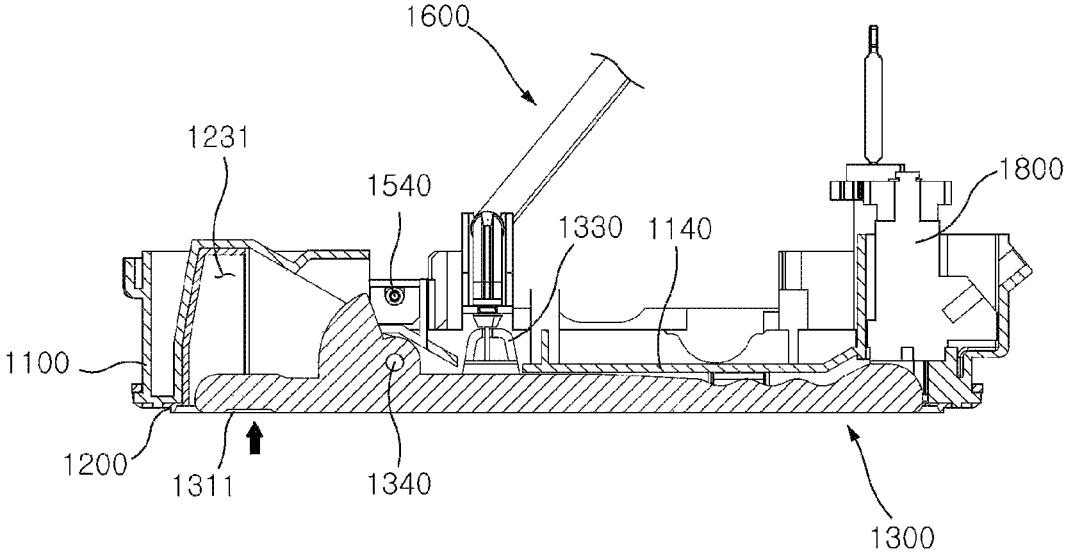
FIG. 23 is a cross-sectional view illustrating an insertion state of the flush handle according to the second exemplary embodiment of the present invention.

When the left side of the handle portion 1300 is pushed backward while the handle portion 1300 is inserted as shown in FIG. 23, the handle portion 1300 rotates clockwise on the rotating shaft 1340.

Figure 24:
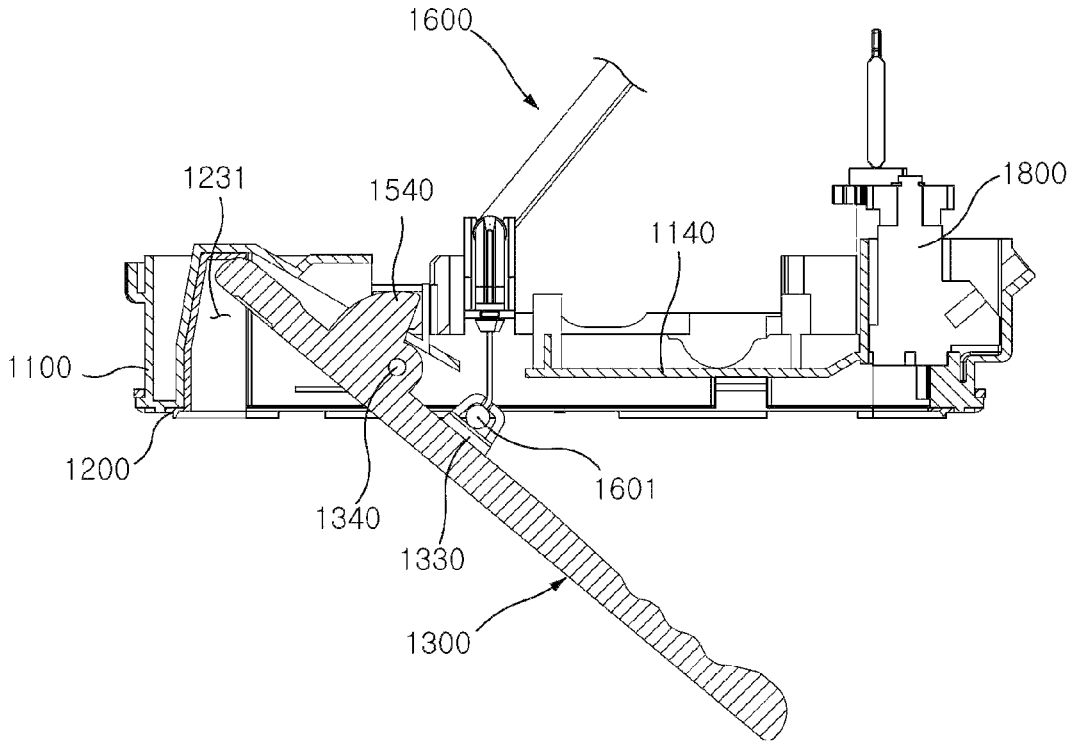
FIG. 24 is a cross-sectional view illustrating a withdrawn and pulled state of the flush handle according to the second exemplary embodiment of the present invention.

After the left side of the handle portion 1300 is pushed until a space between the housing 1100 and the right side of the handle portion 1300 is increased by a certain distance or more, when the user inserts his or her hand into the right side of the handle portion 1300 and pulls the handle portion 1300 as shown in FIG. 24, the handle portion 1300 rotates clockwise on the rotating shaft 1340.

The handle portion 1300 may rotate until the left side of the handle portion 1300 reaches the rear of the rotation-guide groove 1231 of the bumper member 1200.

Here, the handle portion 1300 is rotated without interfering with the handle portion holding protrusion 1777 due to the shape of the interconnection groove 1323*a*.

A method of opening the door of the vehicle by withdrawing the handle portion 1300 is the same as the above description.

<Method of Inserting Handle Portion>

When an external force applied to the handle portion 1300 is removed, the handle portion 1300 returns to an original state due to an elastic restoration force of the return spring 1350.

Here, the driving motor 1741 of the driving portion 1700 rotates in a direction opposite to when the handle portion 1300 is withdrawn such that the handle portion holding protrusion 1777 returns to an original position.

The driving motor 1741 may be set to be driven in an opposite direction according to setting conditions of the vehicle after the driving portion 1700 operates to withdraw the handle portion 1300.

<Method of Operating Oil Damper>

Hereinafter, a method of operating the oil damper 1400 will be described with reference to FIGS. 5 and 37 to 41.

Since FIGS. 37 to 41 are shown as bottom views, clockwise rotation when viewed from above is shown as counterclockwise rotation in the drawings, and counterclockwise rotation when viewed from above is shown as clockwise rotation in the drawings.

Direction A shown in FIGS. 38 to 41 indicates a rotational direction of the rotation portion 1433, and direction B indicates a rotational direction of the sub damper 1440.

Figure 37:
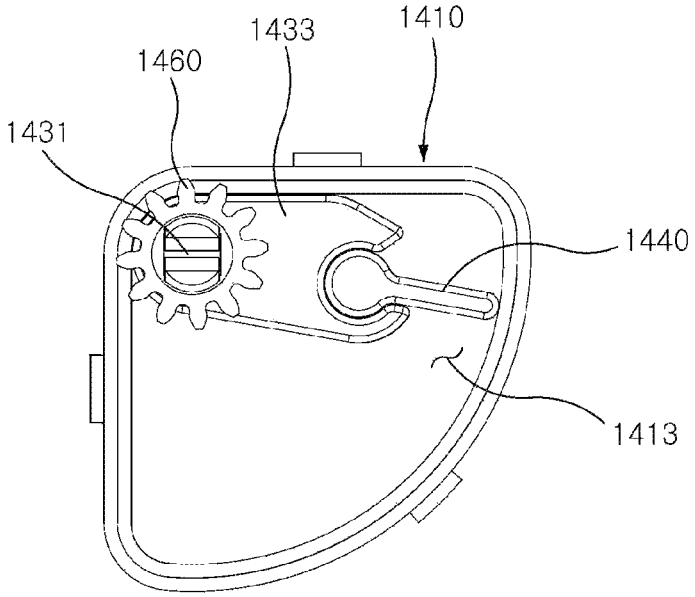
FIG. 37 is a bottom view illustrating a state of the oil damper while the flush handle according to the first exemplary embodiment of the present invention is inserted.

As shown in FIG. 37, in an initial state of the oil damper 1400, the rotation portion 1433 is located in front of the upper case 1410.

The sub damper 1440 maintains a free state within a radius of the rotation portion 1433.

Here, when the handle portion 1300 rotates clockwise and is withdrawn, the damper gear 1460 engaged with the pivot gear 1322 of the handle portion 1300 rotates counterclockwise on the damper shaft 1431.

Figure 38:
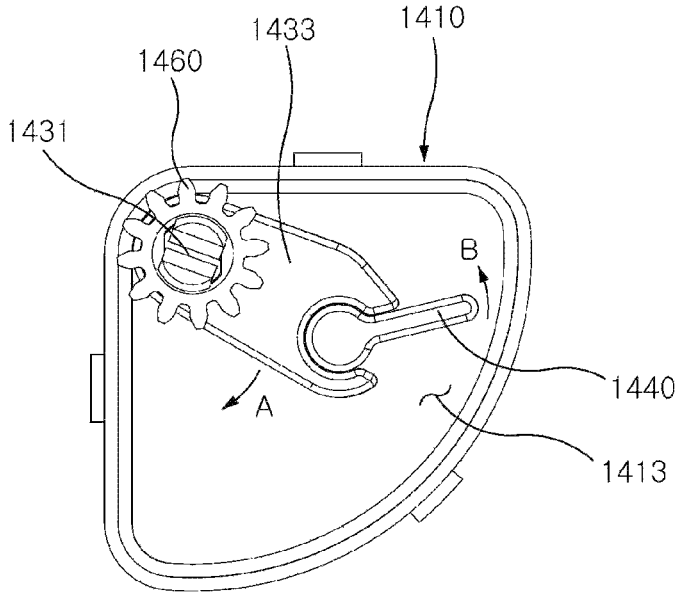
FIG. 38 is a bottom view illustrating a state of the oil damper when the flush handle according to the first exemplary embodiment of the present invention is withdrawn.
Figure 39:
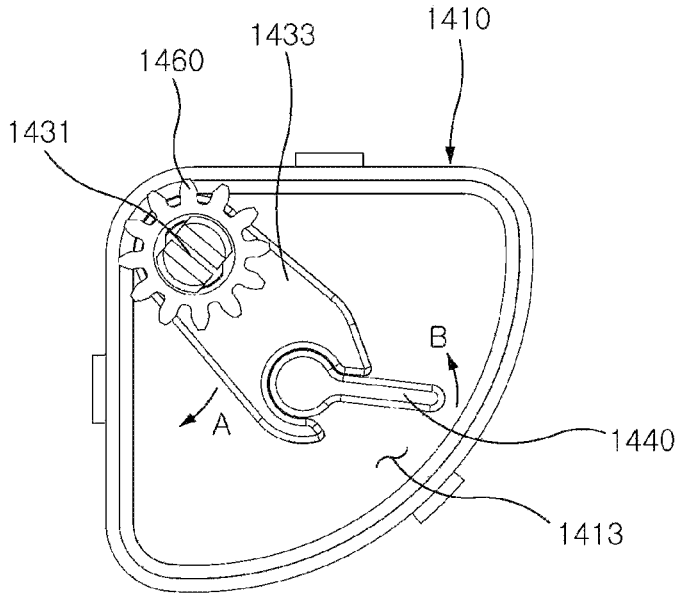
FIG. 39 is a bottom view illustrating a state of the oil damper when the flush handle according to the first exemplary embodiment of the present invention is withdrawn.

Accordingly, as shown in FIGS. 38 and 39, the rotation portion 1433 rotates counterclockwise.

Since the first internal space 1413 of the upper case 1410 is filled with an oil having high viscosity, an inertial force caused by rotation of the rotation portion 1433 is applied to the sub damper 1440. Accordingly, the sub damper 1440 rotates clockwise.

When the sub damper 1440 rotates clockwise, since a space between the sub damper 1440 and the inner surface of the upper case 1410 increases such that the oil easily passes therethrough, resistance against the oil is reduced during rotation.

Subsequently, when the handle portion 1300 rotates counterclockwise and is inserted, the damper gear 1460 engaged with the pivot gear 1322 of the handle portion 1300 rotates clockwise on the damper shaft 1431.

Figure 40:
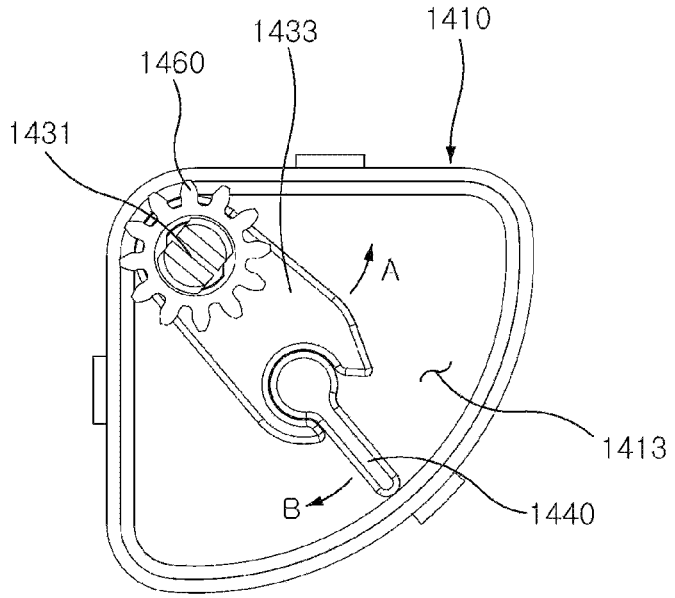
FIG. 40 is a bottom view illustrating a state of the oil damper when the flush handle according to the first exemplary embodiment of the present invention is inserted.
Figure 41:
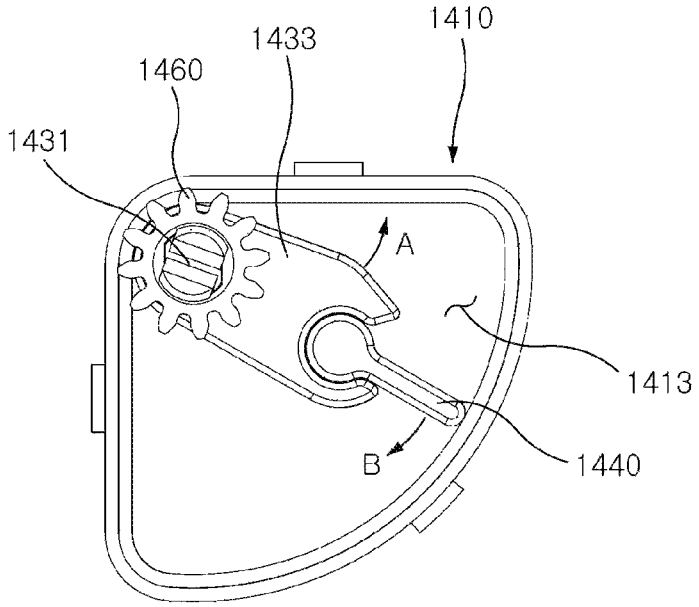
FIG. 41 is a bottom view illustrating a state of the oil damper when the flush handle according to the first exemplary embodiment of the present invention is inserted.

Accordingly, as shown in FIGS. 40 and 41, the rotation portion 1433 rotates clockwise.

Since the first internal space 1413 of the upper case 1410 is filled with an oil having high viscosity, an inertial force caused by rotation of the rotation portion 1433 is applied to the sub damper 1440. Accordingly, the sub damper 1440 rotates counterclockwise.

When the sub damper 1440 rotates counterclockwise, since a space between the sub damper 1440 and the inner surface of the upper case 1410 decreases such that it is difficult for the oil easily to pass therethrough, resistance against the oil is increased during rotation.

That is, when the handle portion 1300 rotates clockwise and is withdrawn, the resistance against the oil is reduced such that the handle portion 1300 quickly rotates. When the handle portion 1300 rotates counterclockwise and is inserted, the resistance against the oil is increased such that the handle portion 1300 slowly rotates. As the handle portion 1300 is slowly inserted, it is possible to prevent a hand from being caught.

Also, since the handle portion 1300 is smoothly operated by the oil, high quality is given.

Second Embodiment

Figure 4:
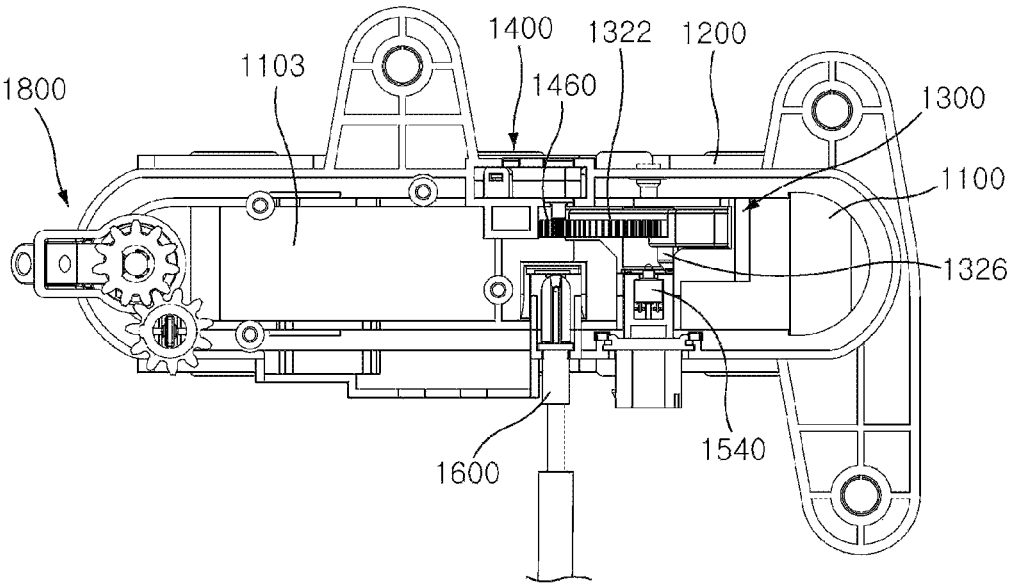
FIG. 4 is a rear view of a flush handle for a door of a vehicle according to a second exemplary embodiment of the present invention.
Figure 5:
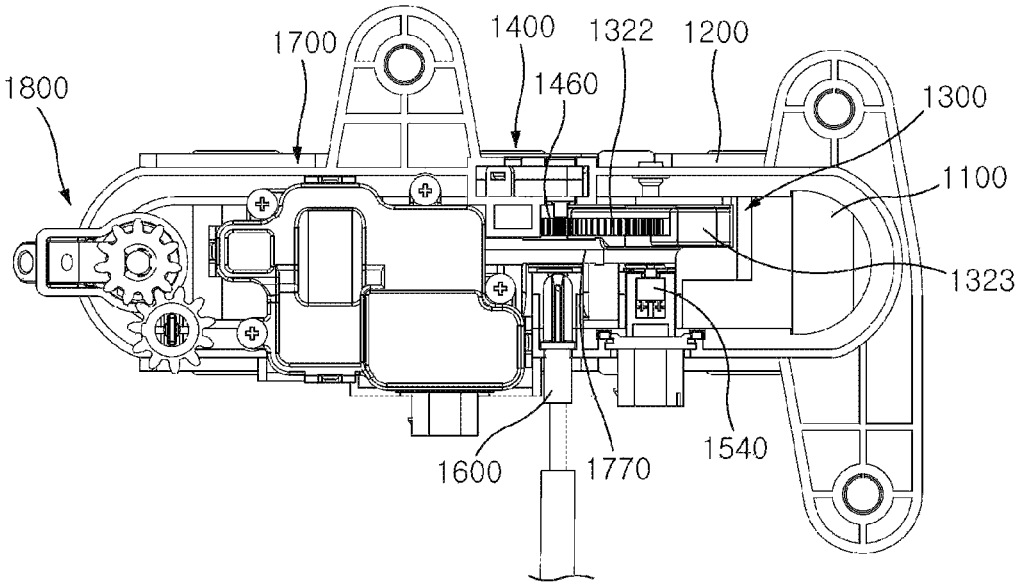
FIG. 5 is a rear view of the flush handle according to the first exemplary embodiment of the present invention.

As shown in FIG. 4, a flush handle fora door of a vehicle according to a second exemplary embodiment of the present invention includes the housing 1100 and the handle portion 1300 installed in the housing 1100. That is, in the second embodiment, unlike the above-described first embodiment, the driving portion 1700 is not installed.

Since the driving portion 1700 is formed as a module, the user may, as necessary, install and use the driving portion 1700 and easily remove the driving portion 1700 by releasing screw-coupling between the housing 1100 and the driving portion 1700.

Hereinafter, a method of opening the door of the vehicle by manually withdrawing the handle portion 1300 will be described with reference to FIGS. 23 and 24.

When the push portion 1311 formed on the left side of the handle portion 1300 is pushed backward while the handle portion 1300 is inserted as shown in FIG. 23, the handle portion 1300 rotates clockwise on the rotating shaft 1340.

After the left side of the handle portion 1300 is pushed until a space between the housing 1100 and the right side of the handle portion 1300 is increased by a certain distance or more, when the user inserts his or her hand into the right side of the handle portion 1300 and pulls the handle portion 1300 as shown in FIG. 24, the handle portion 1300 rotates clockwise on the rotating shaft 1340.

The handle portion 1300 may rotate until the left side of the handle portion 1300 reaches the rear of the rotation-guide groove 1231 of the bumper member 1200.

A method of opening the door of the vehicle by withdrawing the handle portion 1300 is like the above description of the first embodiment.

Although the exemplary embodiments of the present invention have been described above with referenced to the drawings, a variety of corrections and modifications of the present invention may be made by those skilled in the art without departing from the concept and scope of the present invention disclosed in the following claims.

What is claimed is:

1. A flush handle for a door of a vehicle, comprising:
a housing installed in the door of the vehicle;
a handle portion installed in the housing;
a pivot portion formed on one side of the handle portion and comprising a rotating shaft;
an interconnection groove formed in the pivot portion;
a driving portion which is installed in the housing, comprises an opening member having one side coupled to the interconnection groove, and is configured to linearly move and to transfer power to the handle portion; and
a return spring installed on the rotating shaft,
wherein when the opening member linearly moves, the pivot portion rotates on the rotating shaft through the interconnection groove such that the handle portion rotates,
wherein the pivot portion comprises a pivot gear,
the flush handle further comprising an oil damper,
the oil damper comprising a damper gear engaged with the pivot gear and a main damper installed in the oil damper and rotated by the damper gear, and
wherein a gap between the main damper and an inner wall of the oil damper varies according to a rotational direction of the main damper, and the gap is formed to be decreased more when rotation is performed in a direction in which the handle portion is inserted into the housing than when rotation is performed in a direction in which the handle portion is withdrawn from the housing.

2. The flush handle of claim 1, further comprising a sub damper rotating in a direction opposite the rotational direction of the main damper due to an inertial force when the main damper rotates,
wherein a gap between the sub damper and the inner wall of the oil damper is formed to be decreased more when the rotation is performed in the direction in which the handle portion is inserted into the housing than when the rotation is performed in the direction in which the handle portion is withdrawn from the housing.

3. A flush handle for a door of a vehicle, comprising:
a housing installed in the door of the vehicle;
a handle portion installed in the housing;
a pivot portion formed on one side of the handle portion and comprising a rotating shaft; and
a return spring installed on the rotating shaft,
wherein the housing forms an accommodation groove (1102) which accommodates one end of the handle portion,
wherein the handle portion rotates on the rotating shaft and withdrawn from the housing when a pressure is applied to the one end of the handle portion, and
wherein the handle portion is withdrawn into the housing by the return spring when the pressure is removed,
wherein the pivot portion comprises a pivot gear,
the flush handle further comprising an oil damper,
the oil damper comprising a damper gear engaged with the pivot gear and a main damper installed in the oil damper and rotated by the damper gear, and
wherein a gap between the main damper and an inner wall of the oil damper varies according to a rotational direction of the main damper, and the gap is formed to be decreased more when rotation is performed in a direction in which the handle portion is inserted into the housing than when rotation is performed in a direction in which the handle portion is withdrawn from the housing.

4. The flush handle according to claim 1, further comprising:
a sensor portion which is pushed when the handle portion rotates by a certain distance or more; and
an electrically-powered latch portion configured to control fastening, unfastening, opening, and closing of the door of the vehicle,
wherein when the sensor portion is pushed, the door of the vehicle is opened by the electrically-powered latch portion.

5. The flush handle according to claim 1, further comprising:
a manually-operated latch portion or an electrically-powered latch portion, which controls fastening, unfastening, opening, and closing of the door of the vehicle; and
a door latch connection portion having one side installed on the handle portion and the other side installed on the manually-operated latch portion or the electrically-powered latch portion,
wherein when the handle portion rotates by a certain distance or more, the door latch connection portion is pulled such that the door of the vehicle is opened by the manually-operated latch portion or the electrically-powered latch portion.

6. The flush handle according to claim 3, further comprising:
a sensor portion which is pushed when the handle portion rotates by a certain distance or more; and
an electrically-powered latch portion configured to control fastening, unfastening, opening, and closing of the door of the vehicle,
wherein when the sensor portion is pushed, the door of the vehicle is opened by the electrically-powered latch portion.

7. The flush handle according to claim 3, further comprising:
a manually-operated latch portion or an electrically-powered latch portion, which controls fastening, unfastening, opening, and closing of the door of the vehicle; and
a door latch connection portion having one side installed on the handle portion and the other side installed on the manually-operated latch portion or the electrically-powered latch portion,
wherein when the handle portion rotates by a certain distance or more, the door latch connection portion is pulled such that the door of the vehicle is opened by the manually-operated latch portion or the electrically-powered latch portion.

* * * * *